US006801748B2

(12) United States Patent
Sato et al.

(10) Patent No.: US 6,801,748 B2
(45) Date of Patent: Oct. 5, 2004

(54) IMAGE FORMING APPARATUS, SHEET PROCESSING APPARATUS, SHEET PROCESSING METHOD, AND BOOK-BINDING METHOD

(75) Inventors: Chikara Sato, Ohta-ku (JP); Norifumi Miyake, Ohta-ku (JP); Yasuo Fukazu, Ohta-ku (JP); Mitsushige Murata, Ohta-ku (JP); Masatoshi Yaginuma, Ohta-ku (JP); Kiyoshi Okamoto, Ohta-ku (JP); Manabu Yamauchi, Ohta-ku (JP); Tsuyoshi Moriyama, Ohta-ku (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/403,706

(22) Filed: Mar. 31, 2003

(65) Prior Publication Data

US 2003/0202829 A1 Oct. 30, 2003

Related U.S. Application Data

(63) Continuation of application No. 10/011,824, filed on Nov. 5, 2001, now Pat. No. 6,546,226, which is a continuation of application No. 09/488,100, filed on Jan. 18, 2000, now Pat. No. 6,351,625.

(30) Foreign Application Priority Data

Jan. 18, 1999 (JP) ..... 11-009414
Jan. 18, 1999 (JP) ..... 11-009415

(51) Int. Cl.[7] ..... G03G 15/00
(52) U.S. Cl. ..... 399/382; 399/407
(58) Field of Search ..... 399/82, 382, 405, 399/407, 408, 409, 410; 270/58.31, 58.05, 58.08, 32, 45

(56) References Cited

U.S. PATENT DOCUMENTS

| | | | | |
|---|---|---|---|---|
| 5,192,977 A | | 3/1993 | Kaneko et al. | |
| 5,272,511 A | | 12/1993 | Conrad et al. | |
| 5,489,969 A | | 2/1996 | Soler et al. | |
| 5,596,389 A | | 1/1997 | Dumas et al. | 399/16 |
| 5,839,045 A | | 11/1998 | Wierszewski | 399/382 |
| 5,881,352 A | | 3/1999 | Kobayashi et al. | 399/408 |
| 6,276,677 B1 | | 8/2001 | Hommochi et al. | 270/32 |
| 6,330,422 B1 | | 12/2001 | Sato et al. | 399/382 |
| 6,351,625 B1 | * | 2/2002 | Sato et al. | 399/382 |
| 6,546,226 B2 | * | 4/2003 | Sato et al. | 399/382 |

FOREIGN PATENT DOCUMENTS

| | | | | |
|---|---|---|---|---|
| JP | 60-180894 | | 9/1985 | |
| JP | 60-191932 | | 9/1985 | |
| JP | 60-204564 | | 10/1985 | |
| JP | 02081867 A | * | 3/1990 | B65H/37/04 |
| JP | 07048062 A | * | 2/1995 | B65H/37/04 |

* cited by examiner

*Primary Examiner*—Robert Beatty
(74) *Attorney, Agent, or Firm*—Rossi & Associates

(57) ABSTRACT

An image forming apparatus has a sheet processing unit for feeding a cover sheet and a folder for folding the cover sheet with a bundle of recording sheets. The sheet processing unit has a cover sheet feeder for feeding a cover sheet facing upward toward an image forming unit, a reversing unit for reversing the cover sheet so that the cover sheet faces downward, and a conveyor for conveying the reversed cover sheet to the folder in a switchback manner so that the front face of the cover sheet faces the folding roller pair. The folder has a thrusting member for thrusting the bundle of sheets toward the folding roller pair and discharging the folded bundle to a discharge tray.

12 Claims, 29 Drawing Sheets

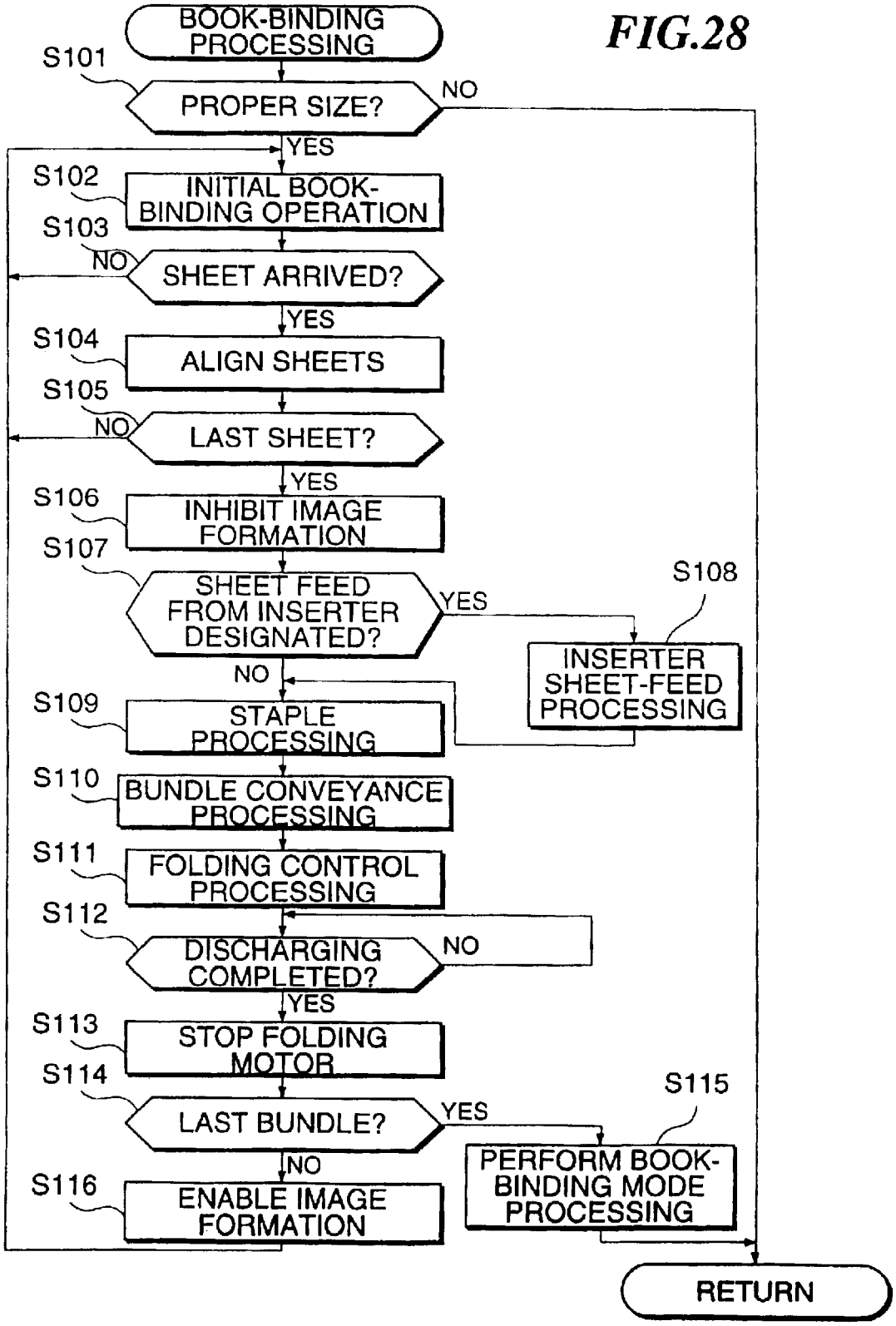
FIG.28
BOOK-BINDING PROCESSING
S101
PROPER SIZE?
NO
YES
S102
INITIAL BOOK-BINDING OPERATION
S103
SHEET ARRIVED?
NO
YES
S104
ALIGN SHEETS
S105
LAST SHEET?
NO
YES
S106
INHIBIT IMAGE FORMATION
S107
SHEET FEED FROM INSERTER DESIGNATED?
YES
S108
INSERTER SHEET-FEED PROCESSING
NO
S109
STAPLE PROCESSING
S110
BUNDLE CONVEYANCE PROCESSING
S111
FOLDING CONTROL PROCESSING
S112
DISCHARGING COMPLETED?
NO
YES
S113
STOP FOLDING MOTOR
S114
LAST BUNDLE?
YES
S115
PERFORM BOOK-BINDING MODE PROCESSING
NO
S116
ENABLE IMAGE FORMATION
RETURN

IMAGE FORMING APPARATUS, SHEET PROCESSING APPARATUS, SHEET PROCESSING METHOD, AND BOOK-BINDING METHOD

CROSS-REFERENCE TO RELATED APPLICATIONS

This application is a continuation application of, and claims priority from, prior pending U.S. patent application Ser. No. 10/011,824, filed Nov. 5, 2001(now U.S. Pat. No. 6,546,226) which is a continuation of Ser. No. 09/488,100 filed Jan. 18, 2000(now U.S. Pat. No. 6,351,625 B1).

BACKGROUND OF THE INVENTION

1. Field of the Invention

The present invention relates to an image forming apparatus, a sheet processing apparatus, a sheet processing method, and a book-binding method which are capable of arranging sheets having images formed thereon and a special sheet or sheets such as cover sheets in alignment into a single bundle of sheets.

2. Description of the Related Art

Conventionally, in an image forming apparatus such as a copying machine, there is provided a cover sheet mode or the like, in which a special sheet or sheets such as cover sheets and ordinary sheets having images formed thereon by an image forming means are arranged in alignment into a single bundle of sheets. Usually, a sheet processing operation such as a binding operation is performed on this bundle of sheets having a special sheet or sheets inserted therein, into a book by a finisher mounted in the main body of the image forming apparatus.

When a cassette is used to supply special sheets such as cover sheets, the special sheets are fed out from the cassette in the timing to insert the special sheets, onto the same conveyance path as the ordinary sheets having images formed thereon. The special sheets thus fed are discharged via the above-mentioned conveyance path. A fixing unit is provided in the conveyance path, and the special sheets are passed through this fixing unit in the same manner as the ordinary sheets.

Where an original having a printed color image is used as such a special sheet, the quality of the printed image may be impaired by heat and pressure exerted when the sheet passes the fixing unit. Recently, color copying papers are increasingly used as the special sheets. When a color copying paper is fed from the cassette, oil and the like adhering to the surface of the color copying paper can impair the conveying efficiency of the paper feeding mechanism, and can significantly lower the reliability of the paper conveyance operation.

On the other hand, it has been proposed to provide the finisher with a special sheet feeder for supplying special sheets such that the special sheets are fed from the finisher. Such a construction has been disclosed, for example, by Japanese Laid-Open Patent Publication (Kokai) No.60-180894, Japanese Laid-Open Patent Publication (Kokai) No.60-191932, and Japanese Laid-Open Patent Publication (Kokai) No.60-204564.

Thus, it has been proposed to provide a unit for special sheets in the image forming apparatus or in a sheet processing device such as the finisher, to arrange the special sheets fed from this unit and the sheets having images formed thereon by the image forming means in alignment into a single bundle of sheets.

However, in proposing a unit for aligning the special sheets such as cover sheets and the ordinary sheets having images formed thereon by the image forming means in alignment into a single bundle of sheets, it has not been considered that the unit should not require a complicated operation by an operator and the productivity should be improved.

SUMMARY OF THE INVENTION

It is an object of the present invention to provide an image forming apparatus, a sheet processing apparatus, a sheet processing method, and a book-binding method that have solved the above-mentioned problems and are capable of arranging sheets having images formed thereon and special sheets such as cover sheets in alignment into a single bundle of sheets without requiring a complicated operation by an operator, and with improved productivity.

To attain the above object, according to a first aspect of the present invention, there is provided an image forming apparatus comprising memory means for storing original image information, image forming means for forming an image indicated by the original image information stored in the memory means on a transfer material and outputting the transfer material, special sheet feeding means for feeding special sheets stacked on a special sheet tray, and post processing means for performing post-processing on the transfer material output from the image forming means and a special sheet fed from the special sheet feeding means; wherein the post processing means includes receiving means for receiving the transfer material output from the image forming means and the special sheet fed from the special sheet feeding means for storage therein in a mixable manner, conveyance path means for conveying the special sheet fed from the special sheet feeding means to the receiving means, and control means for controlling storing the transfer material and the special sheet together in page order in the receiving means, by causing the special sheet to be temporarily halted on standby on the conveyance path means, and thereafter causing the special sheet and the transfer material to be conveyed to the receiving means and stored therein in page order.

Preferably, the receiving means of the post processing means comprises a plurality of receiving means, and the conveyance path means comprises a plurality of conveyance paths, and wherein the control control means of the post processing means is responsive to selection a set post-processing mode from a plurality of post-processing modes, for selecting a receiving means from the plurality of receiving means and a conveyance path from the plurality of conveyance paths, causing the special sheet to be temporarily halted on standby on the selected conveyance path, and thereafter causing the special sheet and the transfer material to be conveyed to the selected receiving means and stored therein in page order.

More preferably, the receiving means of the post processing means includes first receiving means, and the conveyance means includes a first conveyance path, and wherein the control means of the post processing means is responsive to selection of a book-binding mode as the post-processing mode, in which the special sheet and the transfer material are to be folded together in two and bound into a state openable for viewing in page order, for selecting the first receiving means and the first conveyance path, causing the special sheet to be temporarily halted on standby on the first conveyance path, thereafter causing the transfer material output from the image forming means to be conveyed to and received by the first receiving means, and thereafter causing the special sheet on standby on the first conveyance path to be received by the first receiving means.

Further preferably, the image forming means has an image processing function of performing rearranging operation and synthesizing operation on the original image information stored in the memory means, and wherein the image forming means is responsive to selection of the book-binding mode, for performing the rearranging operation and the synthesizing operation of the image processing function on the original image information such that the transfer material can be folded in two into a state openable for viewing in page order.

Typically, the post processing means includes means for stacking the special sheet on the transfer material and causing the first receiving means to receive and store the stacked special sheet and transfer material in a bundle, means for binding the bundle at a center thereof as it is stored in the first receiving means, and means for folding in two the bound bundle at the center and discharging same.

Preferably, the receiving means of the post processing means includes second receiving means other than the first receiving means, and the conveyance path means includes a second conveyance path other than the first conveyance path, and wherein the control means of the post processing means is responsive to selection of a sort mode as the post-processing mode in which a plurality of transfer materials as the transfer material having images indicated by the original image information stored in the memory means formed thereon are arranged in page order, for selecting the second receiving means and the second conveyance path, causing the special sheet to be temporarily halted on standby on the second conveyance path, thereafter causing the special sheet to be conveyed to and received by the second receiving means, and thereafter causing the transfer material output from the image forming means to be conveyed to and received by the second receiving means while causing a next special sheet to be halted on standby on the second conveyance path.

More preferably, the post processing means includes means for stacking the special sheet on the transfer material and causing the second receiving means to receive and store the stacked special sheet and transfer material in a bundle, means for performing a post-processing operation on the bundle as stored in the second receiving means, and means for discharging the bundle on which the post-processing operation has been performed.

To attain the above object, according to a second aspect of the present invention, there is provided a sheet processing method for processing a transfer material and a special sheet in an image forming apparatus including memory means for storing original image information, image forming means for forming an image indicated by the original image information stored in the memory means on the transfer material and outputting the transfer material, special sheet feeding means for feeding special sheets stacked on a special sheet tray, and post processing means for performing post-processing on the transfer material output from the image forming means and a special sheet fed from the special sheet feeding means, the method comprising the steps of providing receiving means and conveyance path means for the post processing means, the receiving means receiving the transfer material output from the image forming means and the special sheet fed from the special sheet feeding means for storage therein in a mixable manner, the conveyance path means conveying the special sheet fed from the special sheet feeding means to the receiving means, and controlling the post processing means to store the transfer material and the special sheet together in page order in the receiving means, by causing the special sheet to be temporarily halted on standby on the conveyance path means, and thereafter causing the special sheet and the transfer material to be conveyed to the receiving means and stored therein in page order.

Preferably, the sheet processing method according to the present invention includes the steps of forming the receiving means of the post processing means of a plurality of receiving means, and forming the conveyance path means of a plurality of conveyance paths, and controlling the post processing means, in response to selection a set post-processing mode from a plurality of post-processing modes, to select a receiving means from the plurality of receiving means and a conveyance path from the plurality of conveyance paths, cause the special sheet to be temporarily halted on standby on the selected conveyance path, and thereafter cause the special sheet and the transfer material to be conveyed to the selected receiving means and stored therein in page order.

More preferably, the sheet processing method according to the present invention includes the steps of forming the receiving means of the post processing means so as to include first receiving means, and forming the conveyance means so as to include a first conveyance path, and controlling the post processing means, in response to selection of a book-binding mode as the post-processing mode, in which the special sheet and the transfer material are to be folded together in two and bound into a state openable for viewing in page order, to select the first receiving means and the first conveyance path, cause the special sheet to be temporarily halted on standby on the first conveyance path, thereafter cause the transfer material output from the image forming means to be conveyed to and received by the first receiving means, and thereafter cause the special sheet on standby on the first conveyance path to be received by the first receiving means.

Further preferably, the sheet processing method according to the present invention includes the steps of forming the image forming means to have an image processing function of performing rearranging operation and synthesizing operation on the original image information stored in the memory means, and controlling the image forming means in response to selection of the book-binding mode, to perform the rearranging operation and the synthesizing operation of the image processing function on the original image information such that the transfer material can be folded in two into a state openable for viewing in page order.

Typically, the sheet processing method according to the present invention includes the step of controlling the post processing means to stack the special sheet on the transfer material and cause the first receiving means to receive and store the stacked special sheet and transfer material in a bundle, bind the bundle at a center thereof as it is stored in the first receiving means, and fold in two the bound bundle at the center and discharging same.

Preferably, the sheet processing method according to the present invention includes the steps of forming the receiving means of the post processing means so as to include second receiving means other than the first receiving means, and forming the conveyance path means so as to include a second conveyance path other than the first conveyance path, and controlling the post processing means in response to selection of a sort mode as the post-processing mode in which a plurality of transfer materials as the transfer material having images indicated by the original image information stored in the memory means formed thereon are arranged in page order, to select the second receiving means and the second conveyance path, cause the special sheet to be temporarily halted on standby on the second conveyance path, thereafter cause the special sheet to be conveyed to and received by the second receiving means, and thereafter cause the transfer material output from the image forming means to be conveyed to and received by the second receiving means while causing a next special sheet to be halted on standby on the second conveyance path.

More preferably, the sheet processing method according to the present invention includes the step of controlling the post processing means to stack the special sheet on the transfer material and cause the second receiving means to receive and store the stacked special sheet and transfer material in a bundle, perform a post-processing operation on the bundle as stored in the second receiving means, and discharge the bundle on which the post-processing operation has been performed.

To attain the above object, according to a third aspect of the present invention, there is provided a image forming apparatus comprising original feeding means for feeding originals stacked on an original tray one by one, image reading means for reading images of the originals fed by the original feeding means, image processing means for performing image processing on the images of the originals read by the image reading means, image forming means for forming the images processed by the image processing means on transfer materials, special sheet feeding means for feeding special sheets stacked on a special sheet tray, and post processing means for inserting at least one of the special sheets into the transfer materials having images formed thereon by the image forming means and performing post-processing operation on the images, wherein the image processing means is responsive to selection of a book-binding mode in which the transfer materials having images formed thereon and at least one of the special sheets inserted therein are to be folded in two and bound together into a state being openable for viewing in page order, for performing synthesizing operation and rearranging operation on images to be formed on the transfer materials such that the bound transfer materials are in proper page order, the post processing means being responsive to selection of the book-binding mode, for inserting at least one of the special sheets into the transfer materials such that orientation of an image on at least one of the special sheets coincides with orientation of the images formed on the transfer materials, and then performing the post-processing operation on the transfer materials with at least one of the special sheets inserted therein.

Preferably, the original feeding means feeds the originals stacked on the original tray in a normal vision position as viewed from an operator, and the special sheet feeding means feeds the special sheets stacked on the special sheet tray in a normal vision position as viewed from the operator.

Also preferably, the image forming means has a sheet inverted discharging function of discharging the transfer materials with surfaces thereof inverted, the post processing means including receiving means for receiving the special sheets fed from the special sheet feeding means and the transfer materials from the image forming means, a first conveyance path for conveying the special sheets fed from the special sheet feeding means in an inverted state to the receiving means, and a second conveyance path for conveying the transfer materials discharged by means of the sheet inverted discharging function from the image forming means to the receiving means, the transfer materials being stored in the receiving means with at least one of the special sheets inserted therein.

Preferably, the special sheet feeding means feeds the special sheets with cover sides thereof in a leading position.

Typically, the post processing means has a binding function of binding together the transfer materials at a center thereof with at least one of the special sheets inserted therein, and a folding function of folding the transfer materials at the center thereof in two with at least one of the special sheets inserted therein.

To attain the above object, according to a fourth aspect of the present invention, there is provided a book-binding method for use in in an image forming apparatus including original feeding means for feeding originals stacked on an original tray one by one, image reading means for reading images of the originals fed by the original feeding means, image processing means for performing image processing on the images of the originals read by the image reading means, image forming means for forming the images processed by the image processing means on transfer materials, special sheet feeding means for feeding special sheets stacked on a special sheet tray, and post processing means for inserting at least one of the special sheets into the transfer materials having images formed thereon by the image forming means and performing post-processing operation on the images, the method comprising the steps of controlling the image processing means to perform synthesizing operation and rearranging operation on images to be formed on the transfer materials such that the bound transfer materials are in proper page order, and controlling the post processing means to insert at least one of the special sheets into the transfer materials such that orientation of an image on at least one of the special sheets coincides with orientation of the images formed on the transfer materials, fold in two the transfer materials with at least one of the special sheets inserted therein, and bind together the transfer materials folded in two with at least one of the special sheets inserted therein into a state being openable for viewing in page order.

Preferably, the book-binding method according to the present invention includes the steps of controlling the original feeding means to feed the originals stacked on the original tray in a normal vision position as viewed from an operator, and controlling the special sheet feeding means to feed the special sheets stacked on the special sheet tray in a normal vision position as viewed from the operator.

More preferably, the book-binding method according to the present invention includes the steps of controlling the image forming means to perform a sheet inverted discharging function of discharging the transfer materials with surfaces thereof inverted, and controlling the post processing means to receive the special sheets fed from the special sheet feeding means and the transfer materials from the image forming means, convey the special sheets fed from the special sheet feeding means in an inverted state to the receiving means, convey the transfer materials discharged by means of the sheet inverted discharging function from the image forming means to the receiving means, and cause the receiving means to receive the transfer materials with at least one of the special sheets inserted therein.

Further preferably, the book-binding method according to the present invention includes the step of controlling the special sheet feeding means to feed special sheets with cover sides thereof in a leading position.

Preferably, the book-binding method according to the present invention includes the step of controlling the post processing means to perform a binding function of binding together the transfer materials at a center thereof with at least one of the special sheets inserted therein, and a folding function of folding the transfer materials at the center thereof in two with at least one of the special sheets inserted therein.

To attain the above object, according to a fifth aspect of the present invention, there is provided a sheet processing apparatus for arranging at least one sheet from a stacking unit and a succession of sheets from an image forming apparatus in alignment into a bundle of sheets, comprising a receiving unit that receives and stores sheets, conveyance means for conveying the at least one sheet from the stacking unit and the succession of sheets from the image forming apparatus to the receiving unit via a conveyance path, and control means for causing conveyance of the at least one sheet from the stacking unit to be started prior to conveyance of the succession of sheets from the image forming apparatus, wherein the control means causes the at least one sheet from the stacking unit which is conveyed prior to conveyance of the succession of sheets from the image forming apparatus, to be temporarily halted on the conveyance path at a location intermediate between the stacking unit and the receiving unit.

In a preferred form of the fifth aspect, the image forming apparatus includes an original stacking unit, and reading means for performing an operation of reading originals set in the original stacking unit, the image forming apparatus forming images indicated by image information obtained by reading the originals and discharging the sheets having images formed thereon to the sheet processing apparatus.

Preferably, orientation of stacking of sheets in the stacking unit coincides with orientation of stacking of originals in the original stacking unit of the image forming apparatus.

Also preferably, the control means inhibits the image forming apparatus from performing an image forming operation for a period of time from start of conveyance of the at least one sheet from the stacking unit to a time at which the at least one sheet from the stacking unit is temporarily halted.

Preferably, the control means permits the image forming apparatus to perform the image forming operation in response to the at least one sheet from the stacking unit being temporarily halted.

Preferably, the receiving unit is responsive to setting of a first mode by the image forming apparatus, for performing a sheet processing operation of arranging the at least one sheet from the stacking unit and the succession of sheets from the image forming apparatus in alignment into a bundle of sheets, and folding the bundle of sheets at a center thereof.

More preferably, the receiving unit comprises a first receiving unit, and a receiving unit other than the first receiving unit, and wherein when the first mode is set, the at least sheet from the stacking unit and the succession of sheets from the image forming apparatus are conveyed to the first receiving unit, while when a mode other than the first mode is set, the at least sheet from the stacking unit and the succession of sheets from the image forming apparatus are conveyed to the receiving unit other than the first receiving unit.

Further preferably, when the first mode is set, the control means is responsive to the succession of sheets from the image forming apparatus being all stored in the first receiving unit, for causing resumption of conveyance of the at least one sheet from the stacking unit being temporarily halted on the conveyance path, while when a mode other than the first mode is set, the control means causes resumption of conveyance of the at least one sheet from the stacking unit being temporarily halted on the conveyance path before a top page sheet of the succession of sheets from the image forming apparatus is stored in the receiving unit other than the first receiving unit.

Advantageously, the control means is responsive to conveyance of all the succession of sheets from the image forming apparatus being completed, for determining whether conveyance of the at least one sheet from the stacking unit being temporarily halted on the conveyance path is to be resumed, or conveyance of the at least one sheet from the stacking unit being temporarily halted on the conveyance path is to be resumed before conveyance of a top page sheet of the succession of sheets from the image forming apparatus, depending upon an operation mode set by the image forming apparatus.

Also advantageously, the control means sets timing in which conveyance of the at least one sheet from the stacking unit being temporarily halted on the conveyance path is to be resumed, depending upon an operation mode set by the image forming apparatus.

Preferably, the control means causes the at least one sheet from the stacking unit to be temporarily halted on the conveyance path at a first position when the first mode is set, and causes the at least one sheet from the stacking unit to be temporarily halted on the conveyance path at a position other than the first position when a mode other than the first mode is set.

Preferably, the control means determines a position in which the at least one sheet from the stacking unit is to be temporarily halted, depending upon an operation mode set by the image forming apparatus.

In a preferred form of the fifth aspect, when the first mode is set, the control means is responsive to the succession of sheets from the image forming apparatus being all stored in the first receiving unit, for causing the at least one sheet from the stacking unit being temporarily halted on the conveyance path to be conveyed by switch back conveyance to the first receiving unit.

In a typical form of the fifth aspect, the sheet processing apparatus includes sheet processing means for performing a sheet processing operation on the at least one sheet from the stacking unit and the succession of sheets from the image forming apparatus, which are stored in the receiving unit, into a bundle of sheets.

The sheet processing means includes staple means for performing a staple operation on the bundle of sheets, and/or folding means for folding the bundle of sheets.

To attain the above object, according to a sixth aspect of the present invention, there is provided a sheet processing method of arranging at least one sheet from a stacking unit and a succession of sheets from an image forming apparatus in alignment into a bundle of sheets, comprising a conveying step of conveying the at least one sheet from the stacking unit and the succession of sheets from the image forming apparatus to a receiving unit that receives and stores sheets, via a conveyance path, and a control step of causing conveyance of the at least one sheet from the stacking unit to be started prior to conveyance of the succession of sheets from the image forming apparatus, wherein the control step causes the at least one sheet from the stacking unit which is conveyed prior to conveyance of the succession of sheets from the image forming apparatus, to be temporarily halted on the conveyance path at a location intermediate between the stacking unit and the receiving unit.

The above and other objects and features of the present invention will become more apparent from the following detailed description taken in conjunction with the accompanying drawings.

BRIEF DESCRIPTION OF THE DRAWINGS

FIG. 28 is a flow chart showing a book-binding process executed in a step S7 of FIG. 23.

DETAILED DESCRIPTION OF THE PREFERRED EMBODIMENT

The present invention will now be described in detail with reference to the drawings showing an embodiment thereof.

Figure 1:
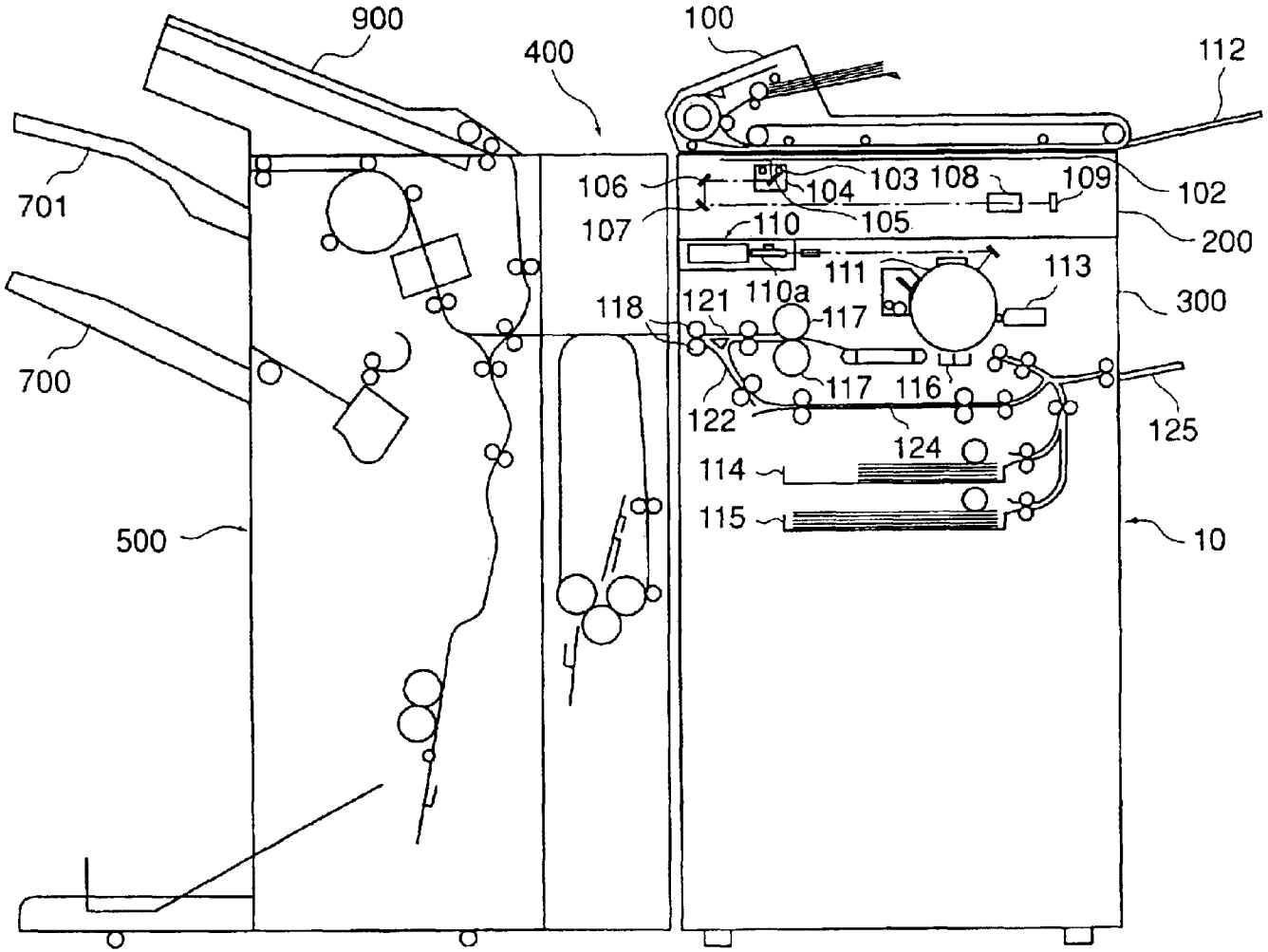
FIG. 1 is a longitudinal sectional view showing the construction of essential parts of an image forming apparatus according to an embodiment of the present invention.

FIG. 1 is a longitudinal sectional view showing essential parts of an image forming apparatus according to an embodiment of the present invention.

As shown in FIG. 1, the image forming apparatus according to the present embodiment is comprised of an image forming apparatus main body 10, a folding unit 400, and a finisher 500. The image forming apparatus main body 10 is comprised of an image reader 200 that reads out an image of an original, and a printer 300.

An original document feeder 100 is mounted on the image reader 200. The original document feeder 100 successively feeds a set of originals one by one to the left as viewed in FIG. 1, starting with the top-page one of the originals that are set on an original document tray with their front or image-formed surfaces facing upward, such that the originals are guided along a curved path to be conveyed from the left onto a platen glass 102, and then through a moving original reading position to the right, and subsequently discharged to an external original discharging tray 112. When the original passes the moving original reading position on the platen glass 102 from left to right, the image of the original is read out by a scanner unit 104 held in a position corresponding to the moving original reading position. This reading method is generally called the moving original reading method. More specifically, when the original passes the moving original reading position, the image-formed surface of the original is illuminated by a lamp 103 of the scanner unit 104, and the reflected light from the original is led via mirrors 105, 106, 107 to a lens 108. The light that has passed the lens is focused on the image plane of an image sensor 109.

By thus conveying the original so as to pass the moving original reading position from left to right, scanning is performed to read the original with a direction normal to the conveyance direction of the original as the main scanning direction and the conveyance direction of the original as the subscanning direction. More specifically, as the original passes the moving original reading position, the image of the original is read out line by line in the main scanning direction by the image sensor 109, while the original is conveyed in the subscanning direction. The whole original image is read out in this manner, and the image that has thus been optically read out is converted to image data by the image sensor 109 and output. The image data output from the image sensor 109 is subjected to predetermined processing by an image signal control unit 202, described later, and is entered as a video signal to an exposure control unit 110 of the printer 300.

The original may be halted at a predetermined position after the original is conveyed onto the platen glass 102 by the original document feeder 100, where the image of the original is read out by causing the scanner unit 104 to scan from left to right. This reading method is the so-called stationary original reading method.

When the original is read without using the original document feeder 100, the original document feeder 100 is first raised by the user and the original is placed on the platen glass 102. Then, the scanner unit 104 is scanned from left to right to read out the original. Thus, when the original is read without using the original document feeder 100, the stationary original reading is performed.

The exposure control unit 110 of the printer 300 modulates laser light based on the entered video signal and outputs the modulated laser light. The laser light is projected onto a photosensitive drum 111 to illuminate the same, while being scanned by a polygon mirror 110*a*. An electrostatic latent image is formed on the photosensitive drum 111 corresponding to the scanned laser light. As described later, when the stationary original reading is performed, the exposure control unit 110 outputs the laser light so as to form a correct image (not the mirror image).

The electrostatic latent image on the photosensitive drum 111 is visualized as a toner image by a developer supplied from a developing unit 113. In timing synchronized with the onset of the illumination of the laser light, a sheet is fed from a cassette 114 or 115, a manual paper feed unit 125 or a double-faced conveyance path 124. The fed sheet is conveyed to a space between the photosensitive drum 111 and a transfer unit 116. The toner image formed on the photosensitive drum 111 is transferred to the sheet by the transfer unit 116.

The sheet on which the toner image has been transferred is conveyed to a fixing unit 117, and the fixing unit 117 fixes the toner image to the sheet with heat and pressure. The sheet that has passed the fixing unit 117 is conveyed via a flapper 121 and discharged from the printer 300 via a discharging roller 118 to an external device (folding unit 400).

Where the sheet is to be discharged with the image-formed surface facing downward, the sheet that has passed the fixing unit 117 is guided by a switching action of the flapper 121 into an inversion path 122, and upon passage of the trailing edge of the sheet through the flapper 121, the sheet is switched back and discharged by the discharging roller 118 from the printer 300. This type of sheet discharging will be hereinafter referred to as the sheet inverted discharging. This sheet inverted discharging is used when image formation is successively performed sheet by sheet starting with the top page, for example, when the original document feeder 100 is used to read out images to be formed, or when an image output from a computer is formed. The thus discharged sheets are stacked in the correct order.

When hard sheets such as OHP sheets are fed from the manual paper feed unit 125 to have images formed thereon, the sheets are not led into the inversion path 122, but are discharged by the discharging roller 118 with the image-formed surfaces facing upward.

Where duplex recording is selected to form images on both sides of a sheet, the control is performed such that the sheet is led to the inversion path 122 by the switching action of the flapper 121, then conveyed to the double-faced conveyance path 124, and the sheet led to the double-faced conveyance path 124 is again fed in the above-mentioned timing to the space between the photosensitive drum 111 and the transfer unit 116.

Figure 2A:
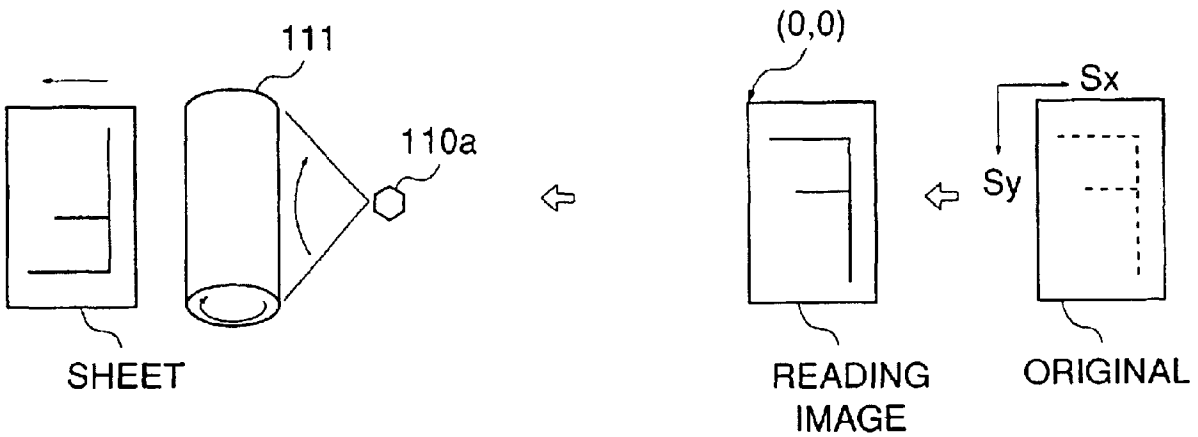
FIG. 2 is a view showing a flow of image formation of the image forming apparatus of FIG. 1, using a stationary original reading method and a moving original reading method, respectively.

Next, the image formation process will be explained with reference to FIGS. 2A and 2B using the stationary original reading method and the moving original reading method. FIG. 2A shows a flow of image formation by the image forming apparatus of FIG. 1, using the stationary original reading method, and FIG. 2B shows a flow of the same using the moving original reading method.

As described above, when a stationary original is read out according to the stationary original reading method, the scanner unit 104 is caused to scan the original image from left to right. More specifically, as shown in FIG. 2A, scanning is performed to read the original image in the main scanning direction Sx and the subscanning direction Sx so that the image is read out by the image sensor 109. Of the image read out by the image sensor 109, the image components read out in the main scanning direction Sy are successively converted to laser light by the exposure control unit 110, and the laser light is scanned by the polygon mirror 110*a* to form an electrostatic latent image on the photosensitive drum 111. The electrostatic latent image is then transferred to a sheet, so that an image (not a mirror image) is formed on the sheet.

Figure 2B:
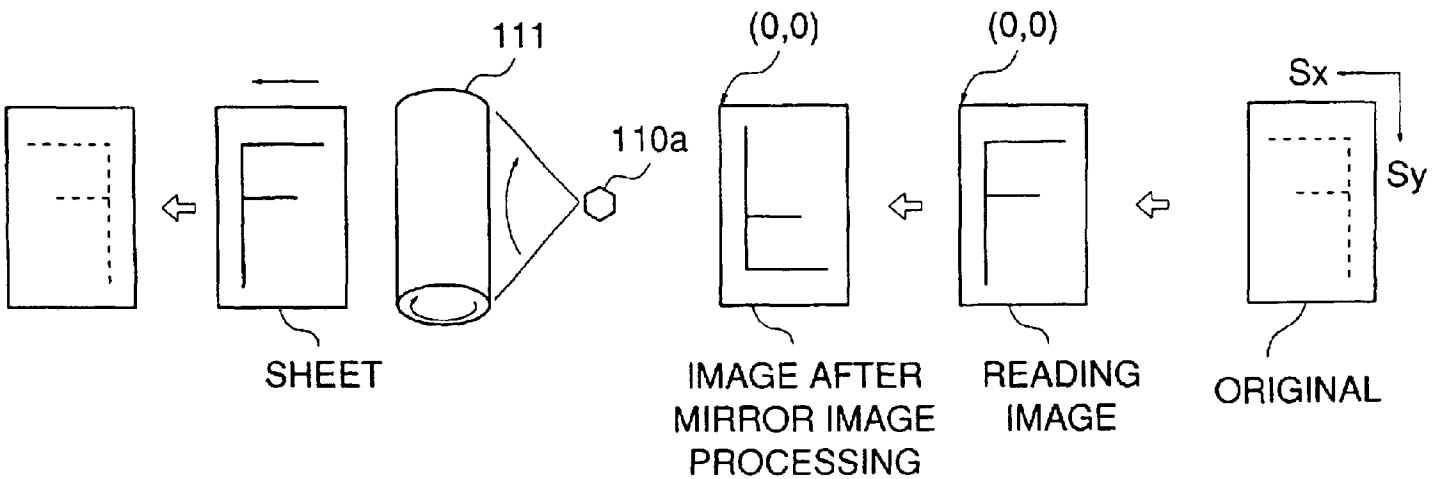

In contrast, when a moving original is read out according to the moving original reading method, as shown in FIG. 2B, scanning is performed on the original image in the primary scanning direction Sy and the secondary scanning direction Sx so that the image is read out by the image sensor 109. Here, according to the moving original reading method, the original is conveyed from left to right so that the subscanning direction is opposite to that in the stationary original reading method. Therefore, the image read out by the image sensor 109 is a mirror image of the original image. This mirror image has to be converted to the correct image. Thus, mirror image processing is performed on the image read out by the image sensor 109 to obtain a correct image. In this mirror image processing, the image read out in the main scanning direction is reversed with respect to the main scanning direction. By this mirror image processing, the image read out by the image sensor 109 is converted to a correct image, so that an electrostatic latent image after the mirror image processing is formed on the photosensitive drum 111. When the electrostatic latent image thus formed is transferred to a sheet, the correct image (not a mirror image) is formed on the sheet. The sheet with this image formed thereon is discharged by the sheet inverted discharging with the image-formed surface directed downward. A rear end of the sheet discharged by the sheet inverted discharging corresponds to the left end of the original image. Therefore, as described later, by binding together the rear ends of the sheets by the finisher 60, the left ends of the sheets with respect to the images will be eventually bound together.

The mirror image processing may be carried out by reversing the subscanning direction. In this case, however, reading of the image of a whole page needs to be completed before the mirror image processing is performed, and the left ends of the sheets with respect to the images have to be bound together by binding together the rear ends of the sheets discharged by the sheet inverted discharging. Therefore, the mirror image processing by reversing the main scanning direction is preferable.

The sheet discharged from the printer 300 is fed to the folding unit 400. The folding unit 400 performs a folding operation to fold the sheet in the form of Z. For example, when the sheets have a A3 size or B4 size and execution of the folding operation is designated, the folding unit 400 performs the folding operation. Otherwise, the sheets discharged from the printer 300 are passed through the folding device 400 as they are, and fed to the finisher 500. An inserter 900 is provided in the finisher 500 to feed special sheets such as cover sheets to be inserted into sheets having images formed thereon. Book-binding, binding operation, punching and like operations are performed by the finisher 500.

Figure 3:
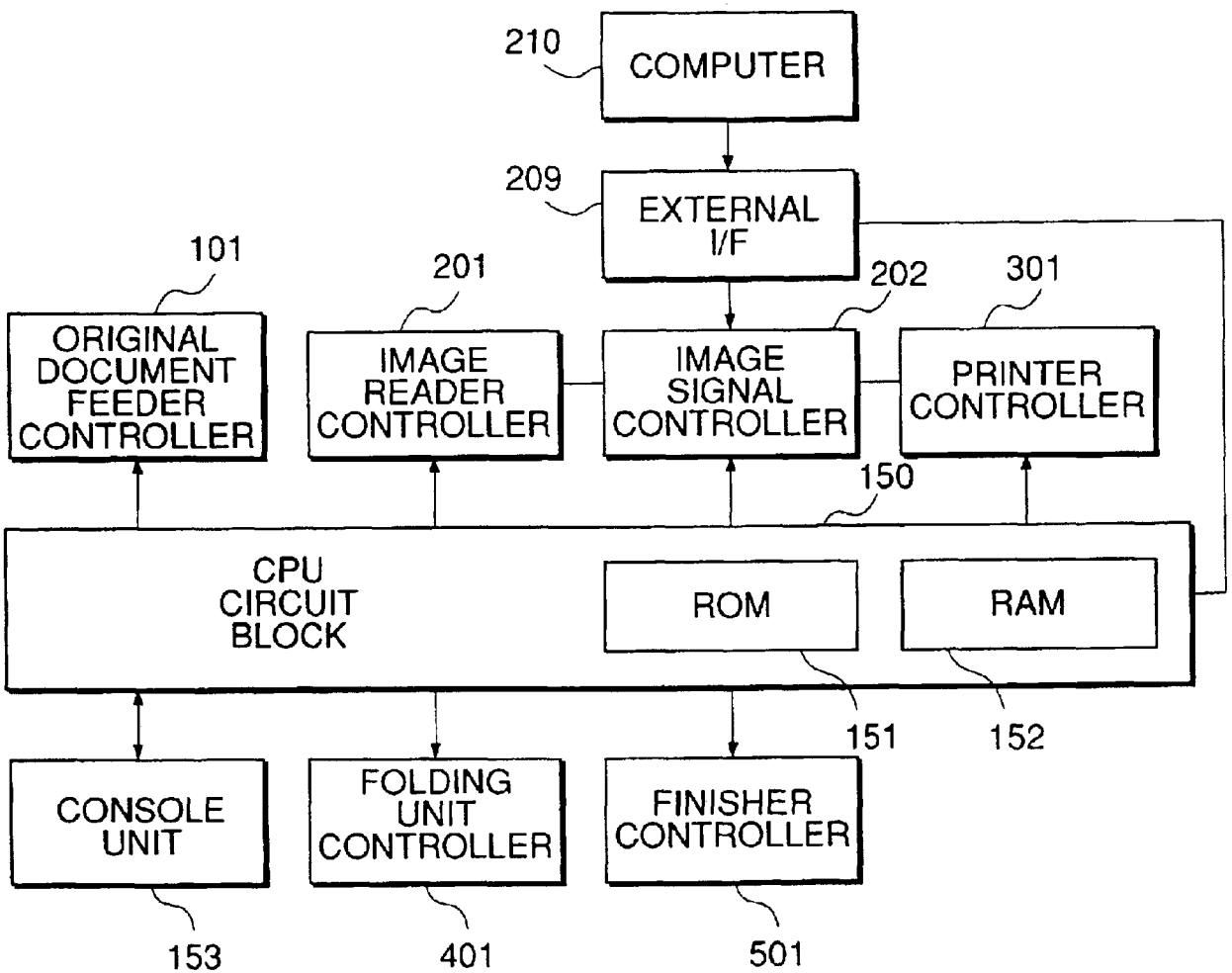
FIG. 3 is a block diagram showing the construction of a controller for controlling the entire image forming apparatus of FIG. 1.

Next, the construction of a controller that controls the entire image forming apparatus will be described with reference to FIG. 3 showing the construction of the controller.

The controller is comprised of a CPU circuit block 150, as shown in FIG. 3. The CPU circuit block 150 includes a CPU, not shown, a ROM 151, and a RAM 152, and comprehensively controls blocks 101, 153, 201, 202, 209, 301, 401, and 501 by means of control programs stored in the ROM 151. The RAM 152 temporarily stores control data, and serves as a work area for operations necessary for the control.

The original document feeder controller 101 controls the operation of the original document feeder 100 based on a command from the CPU circuit block 150. The image reader controller 201 controls the operations of the scanner unit 104, image sensor 109, and others, and transfers an analog image signal output from the image sensor 100 to the image signal control unit 202.

The image signal controller 202 first converts the analog image signal from the image sensor 109 into a digital signal and then performs various processing operations on the digital signal, converts this digital signal into a video signal, and outputs the video signal to the printer control unit 301. The controller 202 also performs various processing operations on a digital image signal entered via the external I/F 209 from a computer 210, converts this digital signal into a video signal, and outputs it to the printer controller 301. The operation of the image signal controller 202 is controlled by the CPU circuit block 150. The printer controller 301 drives the above-mentioned exposure controller 110 based on the input video signal.

A console unit 153 as an operating part includes a plurality of keys for setting various functions related to image formation, and a display for indicating information indicative of the setting status, and outputs a key signal corresponding to the key operation to the CPU circuit block 150, and indicates on the display information corresponding to a signal from the CPU circuit block 150.

The folding unit controller 401 is mounted on the folding unit 400 and controls the operation of the entire folding unit 400 by receiving and transmitting information to and from the CPU circuit block 150.

The finisher controller 501 is mounted on the finisher 500 and controls the operation of the entire finisher 500 by receiving and transmitting information to and from the CPU circuit block 150. The contents of this control will be described later.

Figure 4:
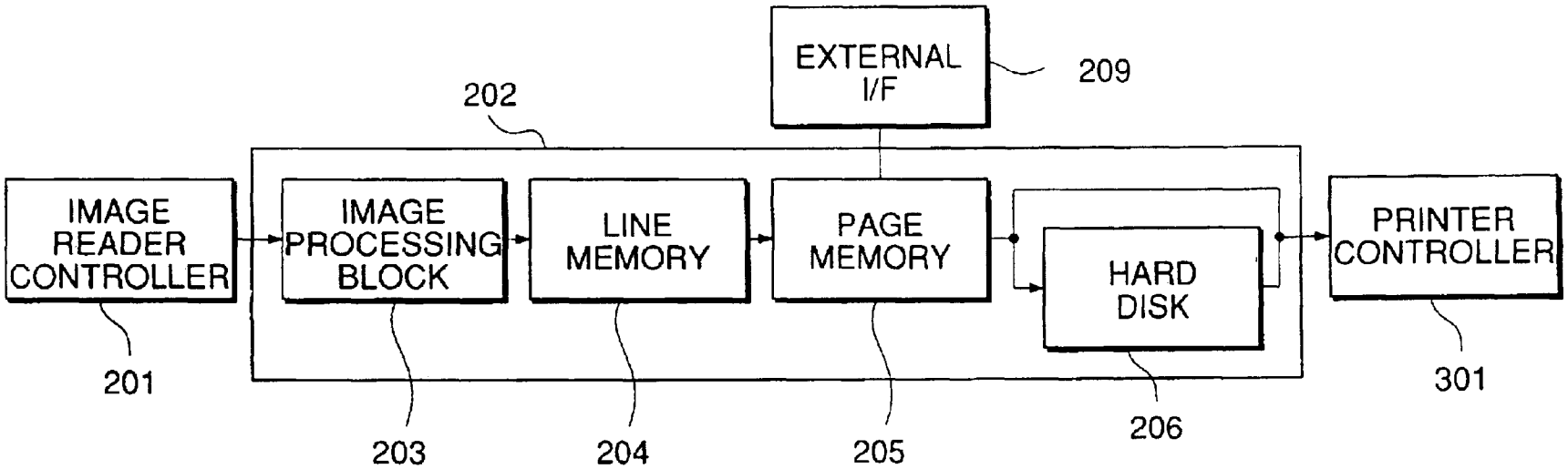
FIG. 4 is a block diagram showing the construction of an image signal control unit 202 appearing in FIG. 3.

Next, the construction of the image signal controller 202 of FIG. 3 will be described with reference to FIG. 4 showing the construction of the same.

As shown in FIG. 4, the image signal controller 202 includes an image processing block 203 that converts the analog image signal from the image reader controller 201 into a digital signal, and performs various processing on this digital signal. The processing operations performed by the image processing block 203 include shading correction, density correction, and editing operations set by the console unit 153 (variable magnification operation such as enlargement and reduction) and the like. Signals resulting from these processing are stored as video data in a line memory 204. When a book-binding mode is selected, image allocation to the sheets is performed based on the number of pages of the originals read out and the number of pages of image data input via an external I/F 209.

The line memory 204 is used for performing the above-mentioned mirror image processing. Video data for one line which has been read out in one main scanning direction is reversed to the opposite direction on this memory, as required. The video data output from the line memory 204 are stored in a page memory 205.

The page memory 205 has a capacity for storing one page of an original of a predetermined size. The video data are stored in the page memory 205 in the order in which they are output from the line memory 204. In the stationary original reading method, the stored video data are read out in the order in which they are stored. The page memory 205 also stores data output from the computer 210 via the external I/F 209.

The video data read out from the page memory 205 are delivered to the printer control unit 301 directly or, if required, after being temporarily stored in a hard disk 206. This hard disk 206 is used for an operation of changing the page order.

Figure 5:
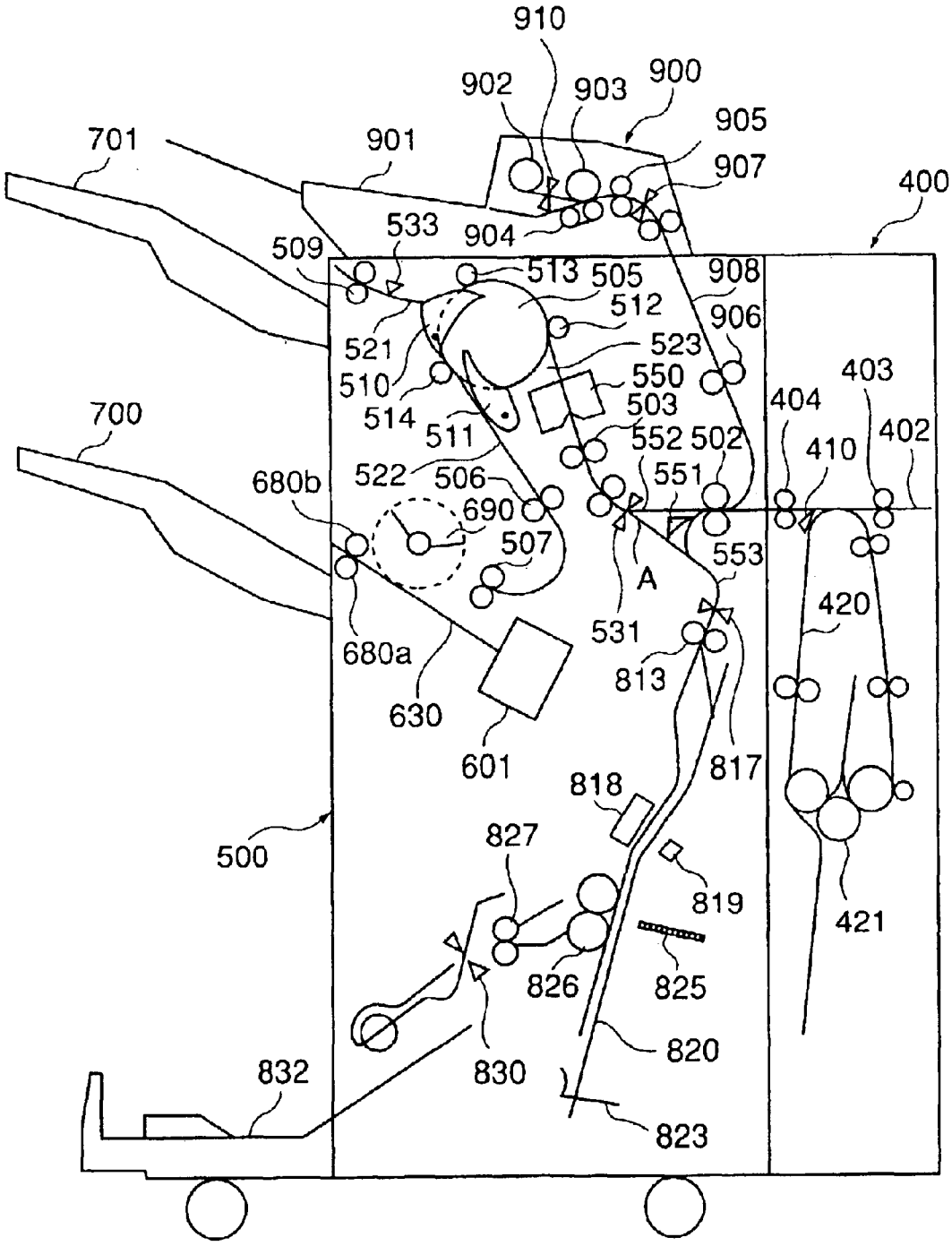
FIG. 5 is a view showing the construction of a folding unit 400 and a finisher 500 appearing in FIG. 1.

Next, the constructions of the folding unit 400 and finisher 500 of FIG. 1 will be described with reference to FIG. 5 showing the constructions of the folding device 400 and the finisher 500.

As shown in FIG. 5, the folding unit 400 includes a folding conveyance horizontal path 402 that introduces sheets discharged from the printer 300 and guides them toward the finisher 500. Conveyance roller pairs 403 and 404 are provided on the folding conveyance horizontal path 402. At an exit of the folding conveyance horizontal path 402 (on the finisher 500 side), there is provided a folding path selection flapper 410. The folding path selection flapper 410 performs a switching action for guiding the sheets on the folding conveyance horizontal path 402 to a folding path 420 or toward the finisher 500.

When a folding operation is performed, the folding path selection flapper 410 is switched on, to guide the sheets to the folding path 420. The sheets guided to the folding path 420 are conveyed to a folding roller 421 to be folded in the form of Z thereby. On the other hand, when the folding operation is not performed, the folding path selection flapper 410 is switched off, and the sheets sent from the printer 300 via the folding conveyance horizontal path 402 are guided directly to the finisher 500.

The finisher 500 successively takes in the sheets discharged via the folding unit 400, and performs a sheet processing operation such as a bundling operation of aligning a plurality of sheets taken in as a single bundle, a stapling operation of stapling a rear end of the bundle, a punching operation of punching the sheets taken in near rear ends thereof, a sort operation, a non-sort operation, and a book-binding operation (in the present embodiment, these operations will be hereinafter referred to as "sheet post-processing"), based on respective operation modes set by the console unit 153 of the image forming apparatus.

As shown in FIG. 5, the finisher 500 includes an entrance roller pair 502 that introduces the sheets discharged from the printer 300 via the folding unit 400 into the finisher 500. Provided downstream of this entrance roller pair 502 is a switching flapper 551 which guides the sheets to a finisher path 552 or to a first book-binding path 553.

The sheets guided to the finisher path 552 are sent toward a buffer roller 505 via a conveyance roller pair 503. The conveyance roller pair 503 and the buffer roller 505 are both reversible in rotating direction, i.e. forward rotation and reverse rotation.

An entrance sensor 531 is provided between the entrance roller pair 502 and the conveyance roller pair 503. A second book-binding path 554 branches off from the finisher path 552 near the entrance sensor 531 on the upstream side in the sheet conveying direction. This branch point will be hereinafter referred to as the branch A. The branch A constitutes a branching point from a conveyance path which conveys sheets from the entrance roller pair 502 to the conveyance roller pair 503. When the conveyance roller pair 503 is reversed in rotation to convey sheets from the conveyance roller pair 503 to the entrance sensor 531, the branch A constitutes a branching point forming a one-way mechanism which conveys sheets only to the second book-binding path 554.

A punching unit 550 is provided between the conveyance roller pair 503 and the buffer roller 505. The punching unit 550 is operated as required so as to punch the conveyed sheets near the rear ends thereof.

The buffer roller 505 is adapted to have a predetermined number of the conveyed sheets wound thereon in lamination, and, if required, small depressing rollers 512, 513, and 514 may be arranged at the periphery of the roller 505 to assist to the sheets to be wound on the roller 505. The sheets wound on the buffer roller 505 are conveyed in the rotating direction of the buffer roller 505.

A switching flapper 510 is provided between the depressing rollers 513 and 514, and a switching flapper 511 is provided on the downstream side of the depressing roller 514. The switching flapper 510 serves to separate the sheets wound on the buffer roller 505 from the latter and guide them to a non-sort path 521 or to a sort path 522. The switching flapper 511 serves to either separate the sheets wound on the buffer roller 505 to guide them to the sort path 522, or guide the sheets as they are wound on the buffer roller 505 to a buffer path 523.

The sheets guided to the non-sort path 521 by the switching flapper 510 are discharged onto a sample tray 701 via a discharging roller pair 509. A sheet discharging sensor 533 is provided in the non-sort path 521, for detecting a jam or the like.

The sheets guided to the sort path 522 by the switching flapper 510 are stacked onto an intermediate tray (hereinafter referred to as "the processing tray") 630 via conveyance rollers 506, 507. The sheets stacked in a bundle on the processing tray 630 are discharged onto a stack tray 700 by discharging rollers 680*a*, 680*b*, after being subjected to aligning operation, stapling operation and so forth as required. A stapler 601 is used for the stapling operation to bind together the sheets stacked in a bundle on the processing tray 630. The operation of this stapler 601 will be described later. The stack tray 700 is freely movable in a vertical direction.

The sheets from the first book-binding path 553 and the second book-binding path 554 are stored in a receiving guide 820 by a conveyance roller pair 813, and are further conveyed until the leading edges of the sheets abut on a movable sheet positioning member 823. A book-binding entrance sensor 817 is provided on the upstream side of the conveyance roller pair 813. Two pairs of staplers 818 are provided in an intermediate position of the receiving guide 820. The stapler 818 cooperates with an anvil 819 arranged opposite thereto to bind a bundle of sheets at a center thereof.

A folding roller pair 826 is provided downstream of the stapler 818. A thrusting member 825 is arranged opposite to the folding roller pair 826. By thrusting out the thrusting member 825 against the bundle of sheets in the receiving guide 820, the bundle of sheets is pushed between the rollers of the folding roller pair 826 to be folded by the folding roller pair 826. Then, the folded bundle of sheets is discharged onto a saddle discharging tray 832 via a folded sheet-discharging roller 827. A book-binding discharging sensor 830 is provided downstream of the folded sheet-discharging roller 827.

When a bundle of sheets that has been bound with the staplers 818 is to be folded, after the stapling operation is completed, the positioning member 823 is lowered by a predetermined distance to bring the stapling position to the center of the folding roller pair 826.

The inserter 900 is provided on the top of the finisher 500. The inserter 900 successively separates a bundle of sheets forming cover sheets and binder sheets stacked on a tray 901, and feeds them to the finisher path 552 or to the book-binding path 553. Special sheets are stacked on the tray 901 of the inserter 900 in a normal vision position as viewed from an operator, that is, stacked on the tray 901 with their front or image-formed surfaces directed upward.

The special sheets on the tray 901 are conveyed by a conveyance roller-feeding roller 902 to a separation unit consisting of a conveyance roller 903 and a separation belt 904, where they are successively separated and conveyed one by one starting with the top sheet.

A draw roller pair 905 is provided downstream of the separation unit. Sheets are separated and stably guided by this draw roller pair 905 to a conveyance path 908. A sheet feed sensor 907 is provided downstream of the draw roller pair 905. A conveyance roller 906 is provided between the sheet feed sensor 907 and the entrance roller pair 502 to lead the special sheets on the conveyance path 908 to the entrance roller pair 502.

Figure 6:
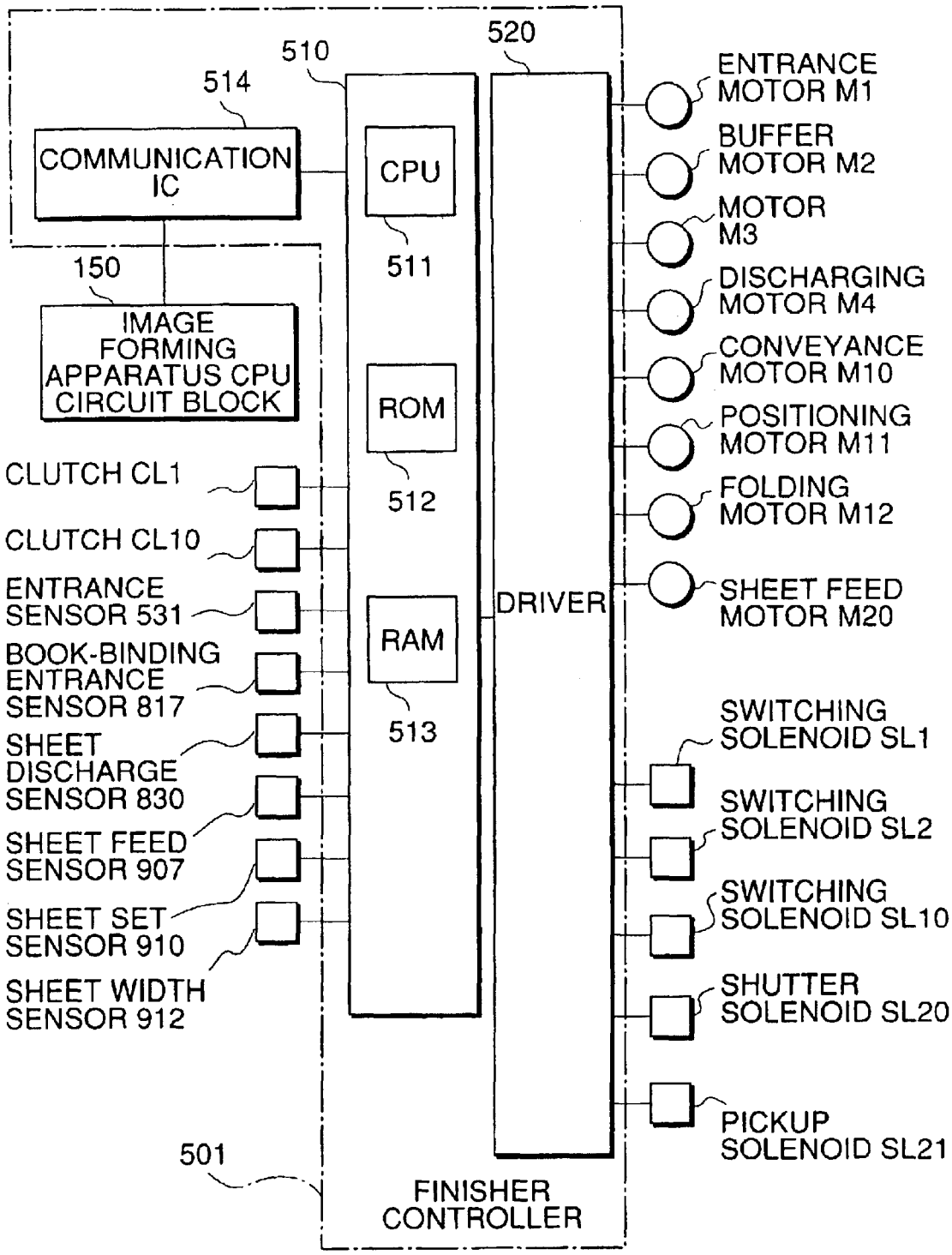
FIG. 6 is a block diagram showing the construction of a finisher control unit appearing in FIG. 3.

Next, the construction of the finisher controller 501 of FIG. 3 that controls the operation of the finisher 500 will be described with reference to FIG. 6 showing the construction of the finisher controller 501.

As shown in FIG. 6, the finisher controller 501 includes a CPU circuit block 510 that is comprised of a CPU 511, a ROM 512, a RAM 513, and so forth. The CPU circuit block 510 communicates with the CPU circuit block 150 provided in the image forming apparatus main body via a communication IC 514 to exchange data, and controls the operation of the finisher 500 by executing various programs (including programs for performing various processing operations as shown in flow charts of FIGS. 23 to 29, referred to later) stored in the ROM 512, based on commands from the CPU circuit block 150.

When the control of the operation of the finisher 500 is performed, output signals from various sensors are taken in by the CPU circuit block 510. These sensors include the entrance sensor 531, the book-binding entrance sensor 817, the book-binding discharge sensor 830, the sheet feed sensor 907, a sheet set sensor 910, a sheet width sensor 912, and so forth. The sheet set sensor 910 detects whether a special sheet or sheets are set on the tray 901 of the inserter 900 or not. A driver 520 is connected to the CPU circuit block 510. The driver 520 drives motors, solenoids, and clutches based on signals from the CPU circuit block 510. Although signals from other sensors, not shown, are taken in by the CPU circuit block 510, description of which is omitted.

The motors include an entrance motor M1 that drives the entrance roller pair 502, the conveyance roller pair 503, and the conveyance roller pair 906, a buffer motor M2 that drives the buffer roller 505, a sheet discharging motor M3 that drives the conveyance roller pair 506, the discharging roller pair 507, and the discharging roller pair 509, a bundle discharging motor M4 that drives the bundle discharging rollers 680*a*, 680*b*, a conveyance motor M10 that drives the conveyance roller pair 813, a positioning motor M11 that drives the sheet positioning member 823, a folding motor M12 that drives the thrusting member 825, the folding roller pair 826, and the folded sheet discharging roller pair 827, and a sheet feed motor M20 that drives the sheet feed roller 902, the conveyance roller 903, the branch belt 904, and the draw roller pair 905 of the inserter 900. Besides these, the driver 520 drives other motors, solenoids, not shown, of which detailed description is omitted.

The entrance motor M1, the buffer motor M2 and the sheet discharging motor M3 are formed by stepping motors. By controlling excitation pulse rates for the motors, the roller pairs driven by the respective motors can be rotated at an equal speed or at respective different speeds. The entrance motor M1 and the buffer motor M2 can be both driven in forward and reverse rotation by the driver 520.

The conveyance motor M10 and the positioning motor M11 are formed by stepping motors, and the folding motor M12 a DC motor. The conveyance motor M10 is disposed to be synchronized in speed with the entrance motor M1 to enable the sheets to be conveyed.

The sheet feed motor M20 is formed by a stepping motor, and disposed to be synchronized in speed with the entrance motor M1 to enable the sheets to be conveyed.

The solenoids include a solenoid SL1 that performs switching of the switching flapper 510, a solenoid SL2 that performs switching of the switching flapper 511, a solenoid SL10 that performs switching of the switching flapper 551, a solenoid SL20 that drives a sheet feed shutter, not shown, of the inserter 900, and a solenoid SL21 that drives the sheet feed roller 902 of the inserter 900 so as to move upward and downward.

The clutches include a clutch CL1 that transmits the driving force of the folding motor M12 to the thrusting member 825, and a clutch CL10 that transmits the driving force of the sheet feed motor M20 to the sheet feed roller 902.

Figure 7A:
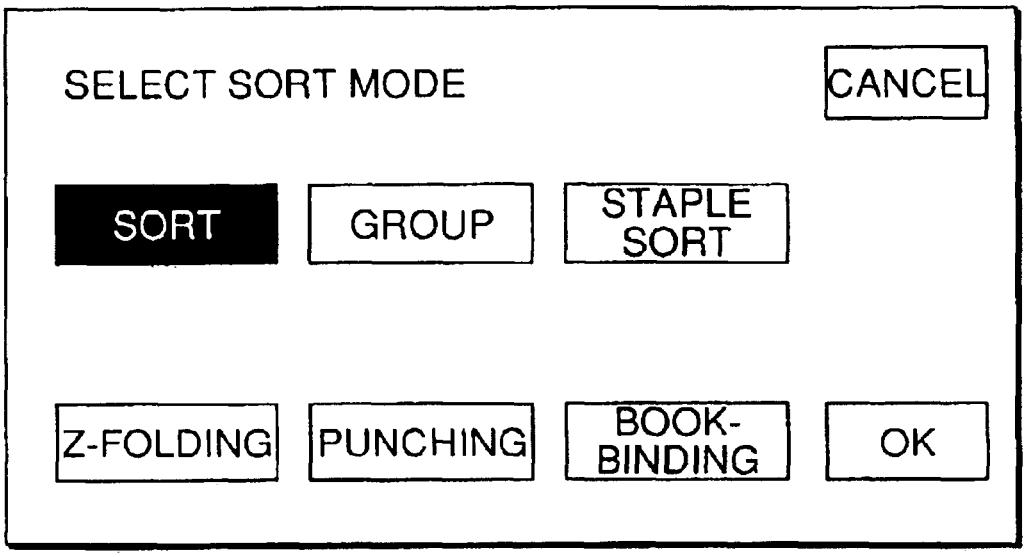
FIG. 7A is a view showing an example of screen view for setting a post-processing mode in an operating part of the image forming apparatus of FIG. 1.
Figure 7B:
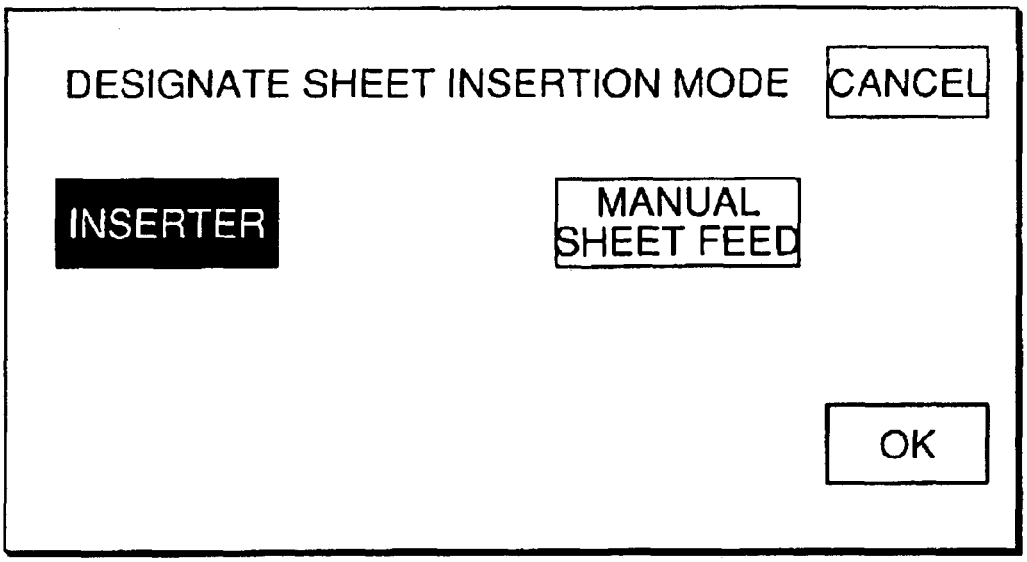
FIG. 7B is a view showing an example of screen view for setting a cover insertion mode.

Next, an example of a selection operation in a post-processing mode using the console unit 153 of the image forming apparatus of FIG. 1 will be described with reference to FIGS. 7A and 7B showing examples of views on the screen related to the selection operation.

In the present embodiment, the post-processing mode includes a non-sort mode, a sort mode, a staple sort mode (binding mode), a book-binding mode, and so forth. Besides, the post-processing mode further includes an inserter mode (or manual sheet feed mode) in which special sheets (colored paper, thick paper, or the like) are inserted as cover sheets or the like into ordinary sheets with images formed thereon by the image forming block. All these modes can be independently set. Setting of these modes is performed by input operations to the console unit 153.

When the post-processing mode is to be set, a menu selection screen view as shown in FIG. 7A, for example, is displayed on the console unit 153, and setting of the post-processing mode is carried out using this menu selection screen view. When the inserter mode is to be set, a screen view as shown in FIG. 7B, for example, is displayed on the console unit 153. Whether the cover sheet insertion is carried out from the inserter 900 or from the manual sheet feed unit 125 can be set by using an "inserter" key or a "manual sheet feed" key on the screen view. When a sheet is fed from the inserter 900, the sheet has already an image formed thereon.

Next, the conveyance of sheets from the inserter 900 and the printer 300 to the processing tray 630 in the finisher 500 in the sort mode will be explained with reference to FIGS. 8A to 13, which are views useful in explaining a flow of sheets from the inserter 900 and the printer 300 to the processing tray 630 in the finisher 500 in the sorting mode of the image forming apparatus of FIG. 1.

Figure 8A:
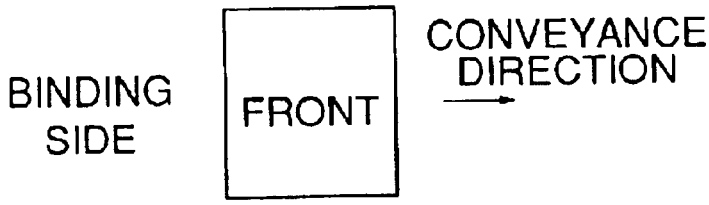
FIG. 8A is a view showing a manner in which a sheet is set on a tray.
Figure 8B:
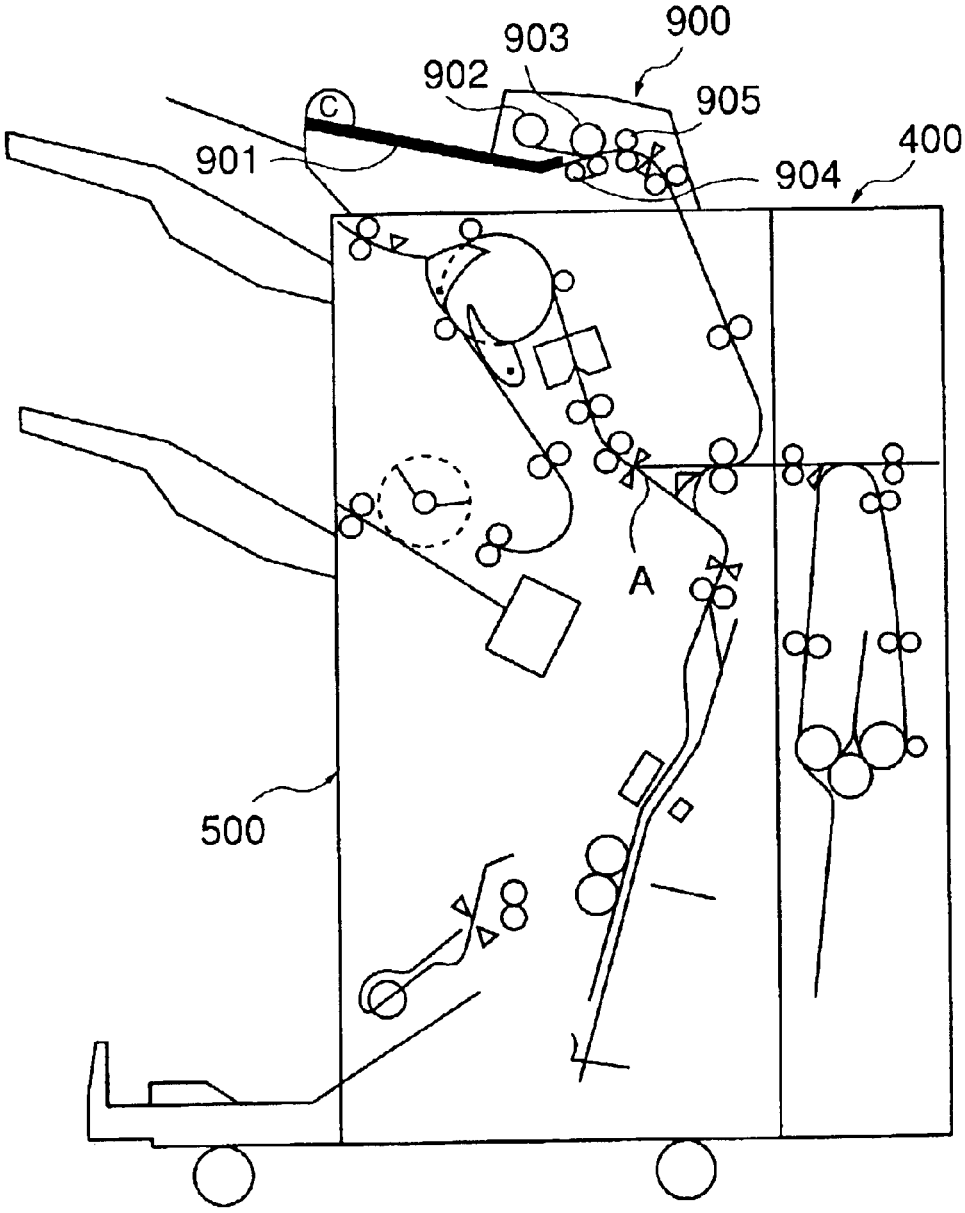
FIG. 8B is a view useful in explaining a flow of sheets from an inserter and a printer to a processing tray in a finisher in a sort mode of the image forming apparatus of FIG. 1.

When a sheet C is inserted as a cover sheet into sheets with images formed thereon, the sheet is set on the tray 901 of the inserter 900, as shown in FIG. 8B. Specifically, the sheet C is set, as shown in FIG. 8A, with a front image surface thereof facing upward and a binding side thereof on the left side as viewed from the operator, and is fed in a direction indicated by the arrow in FIG. 8A. The sheet C is thus set in the same manner as originals set in the original document feeder 100, facilitating the setting of the sheet C.

Figure 9:
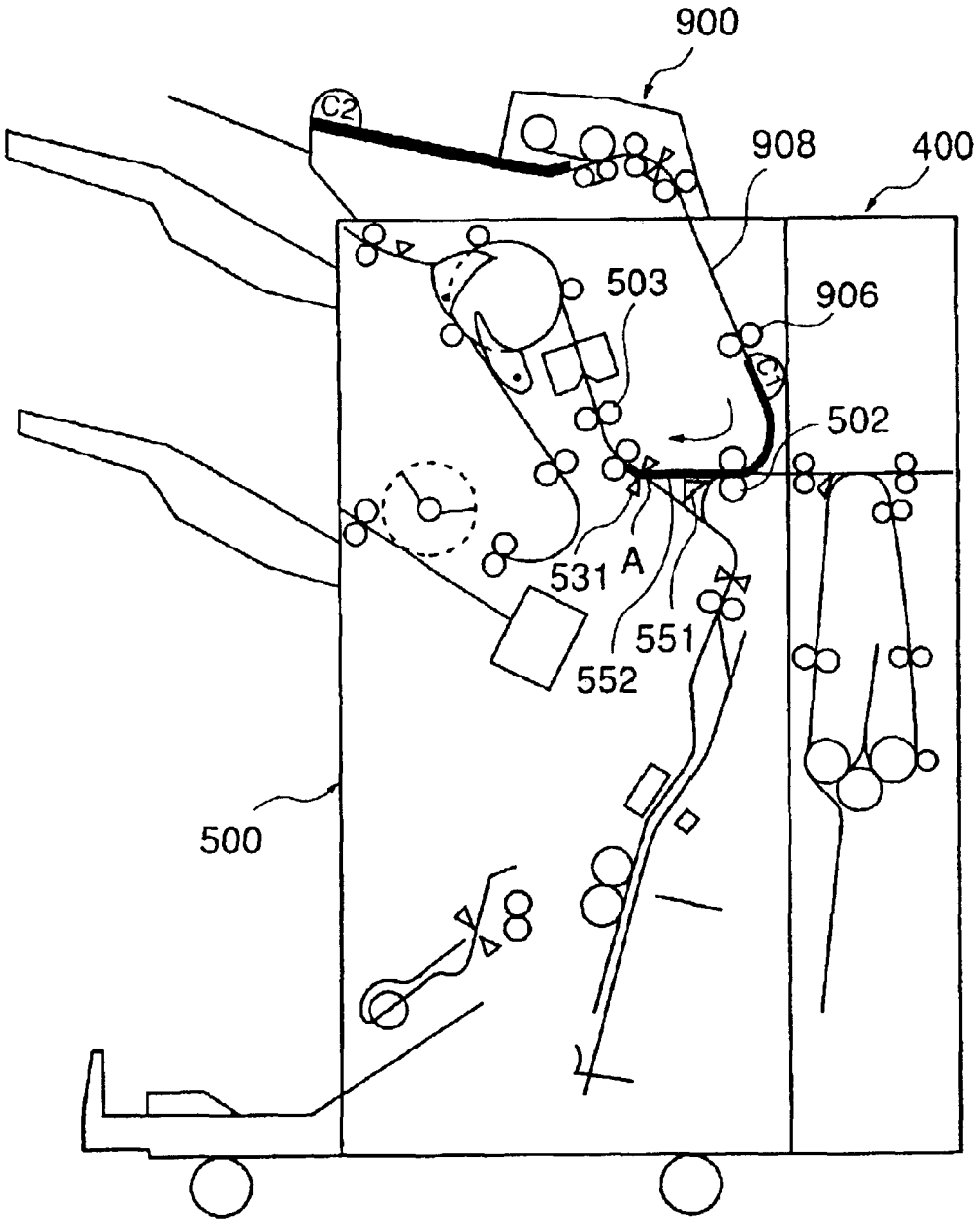
FIG. 9 is another view useful in explaining the same flow of sheets.

After a plurality of the sheets C have been set on the tray 901, and a start key, not shown, on the console unit 153 is depressed by the operator, the top sheet C1 starts to be fed, and the switching flapper 551 is switched to the finisher path 552 side, as shown in FIG. 9. The sheet C1 is guided through the conveyance path 908 to the finisher path 552 via the entrance roller pair 502. Upon detection of the leading edge of the sheet C1 by the entrance sensor 531, a sheet with an image formed thereon (a sheet P1 shown in FIG. 10) starts to be fed from the printer 300.

Figure 10:
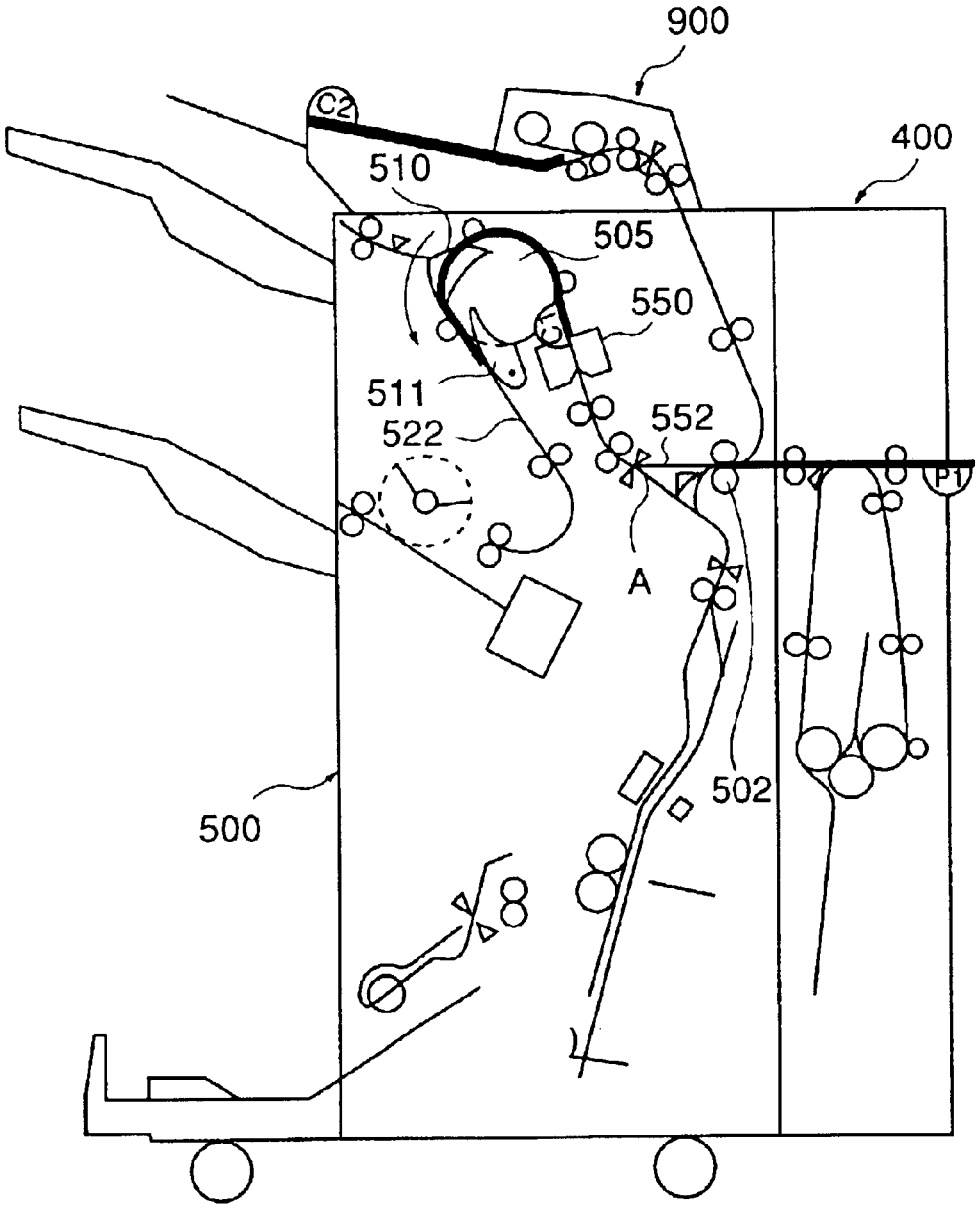
FIG. 10 is a further view useful in explaining the same flow of sheets.

Then, as shown in FIG. 10, the sheet P1 fed from the printer 300 is fed to the finisher 500, and the sheet C1 is fed to the sort path 522 via the buffer roller 505. At this time, the switching flappers 510, 511 are both switched to the sort path 522 side.

Figure 11:
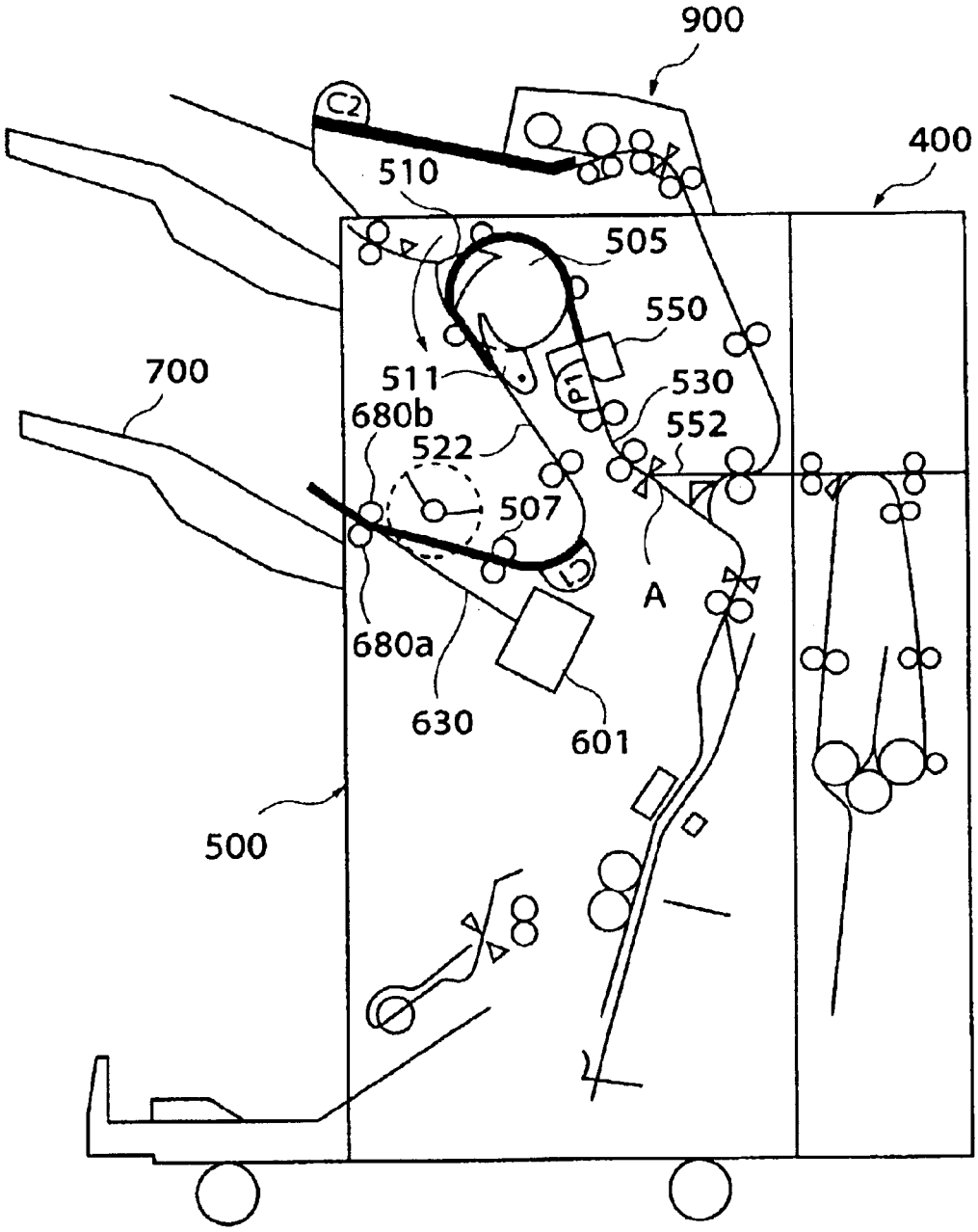
FIG. 11 is a still further view useful in explaining the same flow of sheets.
Figure 12:
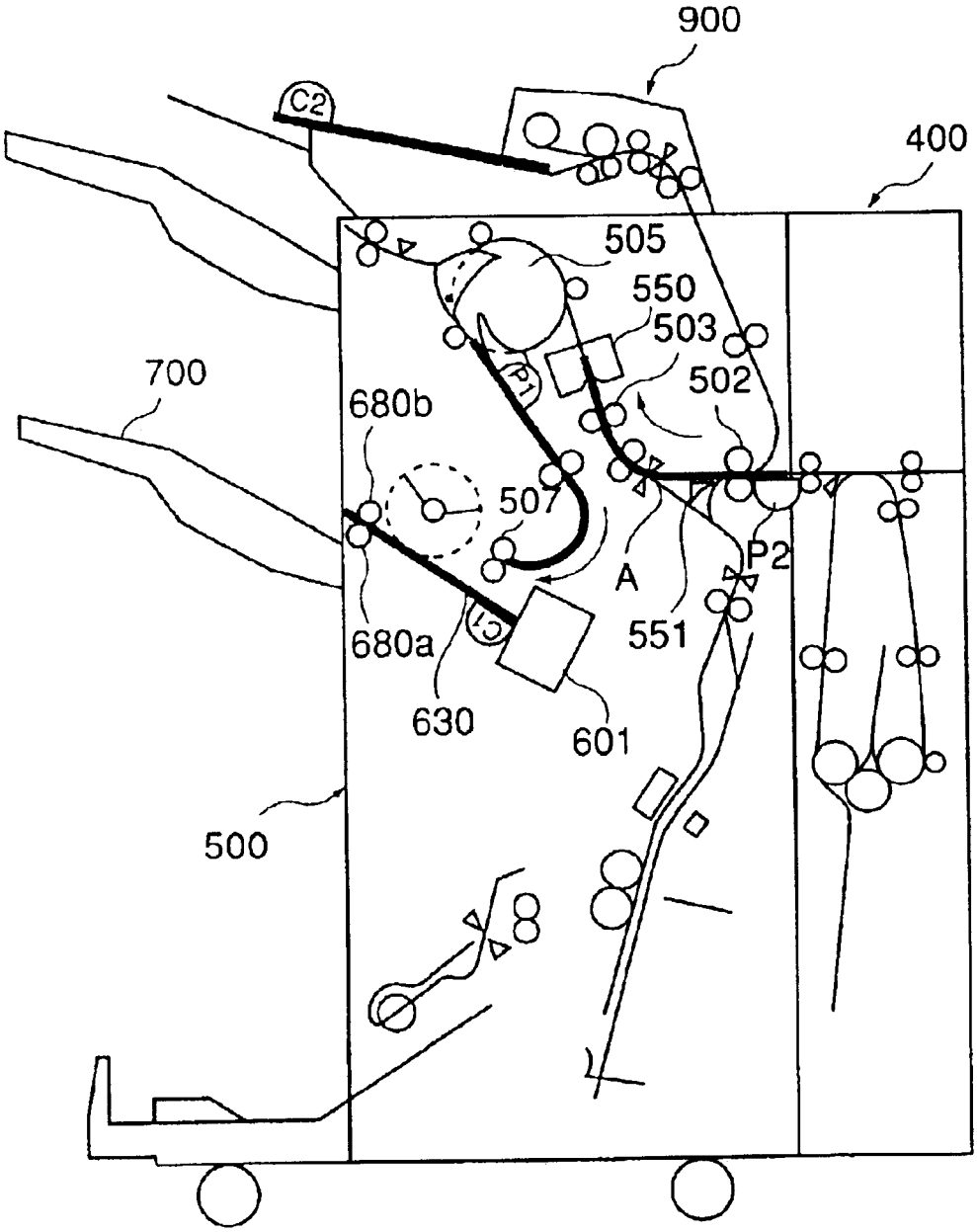
FIG. 12 is a further view useful in explaining the same flow of sheets.
Figure 13:
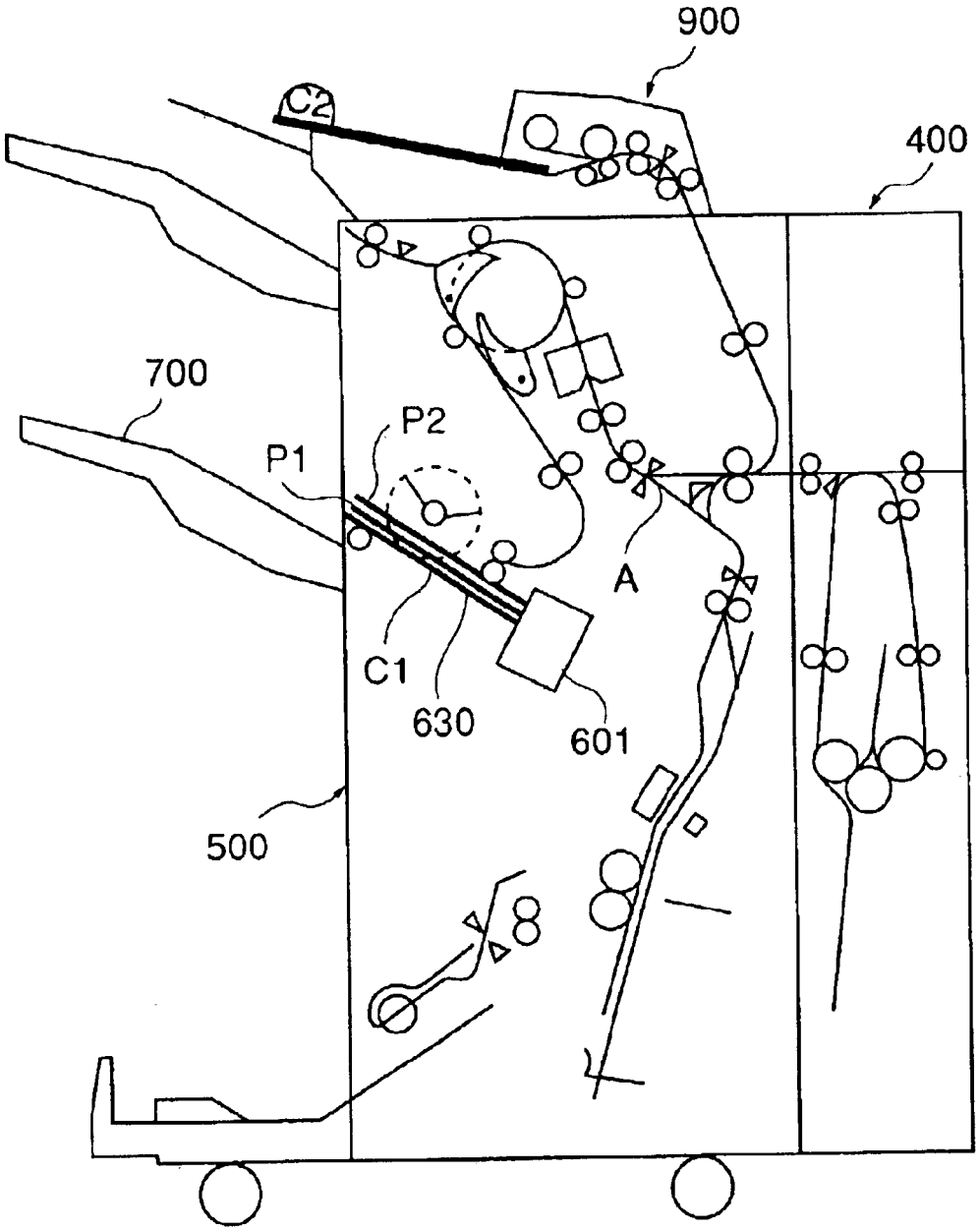
FIG. 13 is another view useful in explaining the same flow of sheets.

As shown in FIG. 11, the sheet C1 fed to the sort path 522 is received by the processing tray 630 and stored thereon, while the sheet P1 from the printer 300 is fed to the finisher path 552. Then, as shown in FIG. 12, in the same manner as the sheet C1, the sheet P1 is fed to the sort path 522 via the buffer roller 505, and conveyed toward the processing tray 630, while a sheet P2 that follows the sheet P1 is fed to the finisher path 552. Then, as shown in FIG. 13, the sheet P1 is received by the processing tray 630 and stacked on the sheet C1 that has already been received by the processing tray 630. Subsequently, the sheet P2 that follows the sheet P1 is received by the tray 630 and stacked on the sheet P1.

Each of the sheets P1, P2 has an image formed thereon that has been obtained by the mirror image processing. Since the sheets P1, P2 are discharged by the sheet inverted discharging, the sheets P1, P2 are received by the processing tray 630 with their image-formed surfaces facing downward and their binding sides on the the stapler 601 side, as is the case with the sheet C1. Although not shown in FIG. 13, the sheet processing apparatus of the present embodiment is constructed such that when a special sheet (for example, a sheet C2) is to be inserted into the next bundle (that is, the next job), while the sheets P1, P2 which constitute the current bundle (that is, the current job) and which are to be mixed with the sheet C1, are being conveyed, the special sheet for the next job (the sheet C2) is fed to the conveyance path 908 and kept on standby (temporarily halted on the path 908). By thus feeding a special sheet to be used as the cover in the next job from the inserter 900 and keeping it on standby on the path 908 in the finisher 500, while the current job is being processed, the productivity of the sort mode operation can be improved.

Next, the image formation in the book-binding mode will be explained with reference to FIGS. 14A to 14D which are views useful in explaining the image formation in the book-binding mode of the image forming apparatus of FIG. 1.

When the book-binding mode is designated, originals set on the original document feeder 100 are read out successively starting with the top page. The images of the originals are sequentially stored in the hard disk 206, and the number of originals read out is counted at the same time.

When the reading of the originals is completed, the images of the originals read out are classified according to the following equation (1), to determine the order of image formation and image forming positions.

$$M=n\times 4-k \quad (1)$$

M: number of originals n: integer not less than 1, representing the number of sheets k: a value of 0, 1, 2 or 3

Detailed description of the order of image formation and the image forming positions is omitted.

Figure 14A:
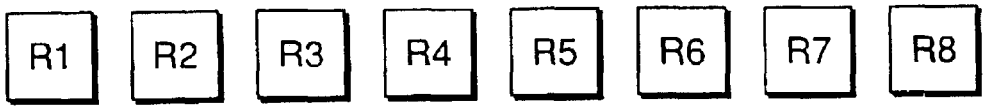
FIG. 14 is a view useful in explaining image formation in a book-binding mode of the image forming apparatus of FIG. 1.

Let it be assumed that the image formation in the book-binding mode is carried out with the number of originals read out being 8. As shown in FIG. 14A, image data of the originals corresponding to 8 pages (R1 to R8) are stored in the hard disk 206 in the order of reading.

Figure 14B:
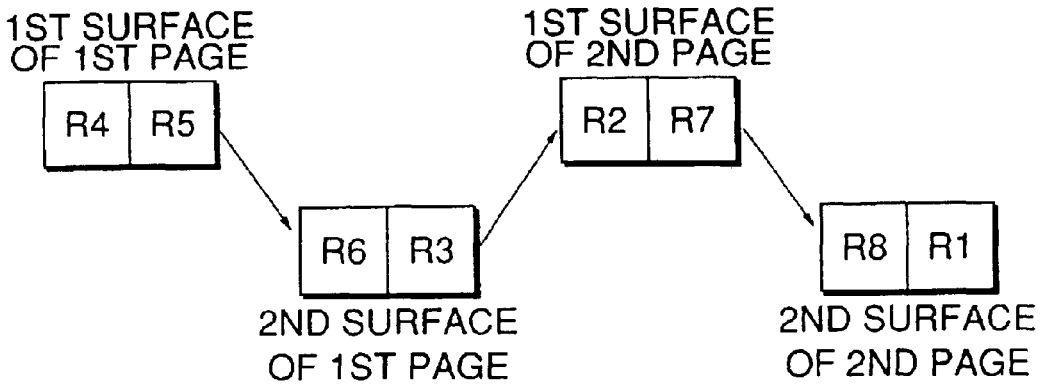
Figure 14C:
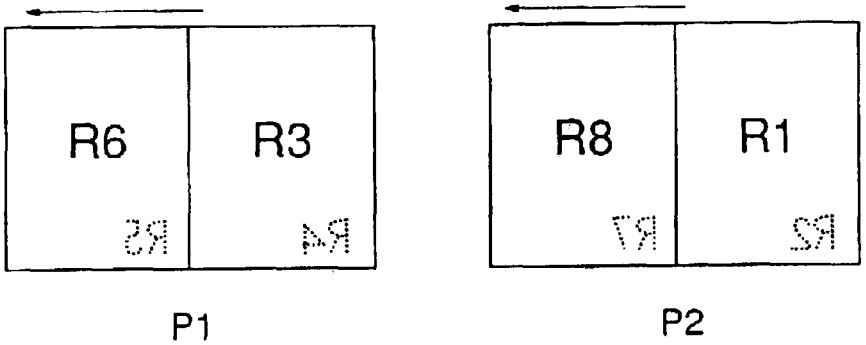

The order of image formation and the image forming position are determined for each piece of image data (R1 to R8). Based on results of the determination, after the above-mentioned mirror image processing has been performed, an image R4 is formed on a left half of a first surface (front surface) of the first-page sheet P1, and an image R5 is formed on a right half of the same, as shown in FIG. 14B. The sheet P1 is then fed to the double-faced conveyance path 124. The sheet P1 is further fed to the transfer unit 116, where an image R6 is formed on a left half of a second surface (back surface) of the sheet P1, and an image R3 is formed on a right half of the same. The sheet P1 having images thus formed on both sides is fed as it is to the book-binding path 553 in the finisher 500. Thus, as shown in FIG. 14C, the sheet P1 is discharged from the image forming apparatus main body and taken in by the finisher 500 with the second surface having the images R6 and R3 formed thereon facing upward and with the image R6 in the leading position. The left-hand arrow in FIG. 4C indicates the direction of the sheet conveyance.

Then, an image R2 is formed on a left half of a first surface (front surface) the second-page sheet P2, and an image R7 is formed on a right half of the same. The sheet P2 is then fed to the double-faced conveyance path 124. The sheet P2 is further fed to the transfer unit 116, where an image R8 is formed on a left half of a second surface (back surface) of the sheet P2, and an image R1 is formed on a right half of the same. The sheet P2 is fed as it is to the first book-binding path 553 in the finisher 500. As shown in FIG. 14C, the sheet P2 is discharged from the image forming apparatus main body, and taken in by the finisher 500 with the second surface having the images R8 and R1 thus formed thereon facing upward and with the image R8 in the leading position. The right-hand arrow in FIG. 4C indicates the direction of the sheet conveyance.

Figure 14D:
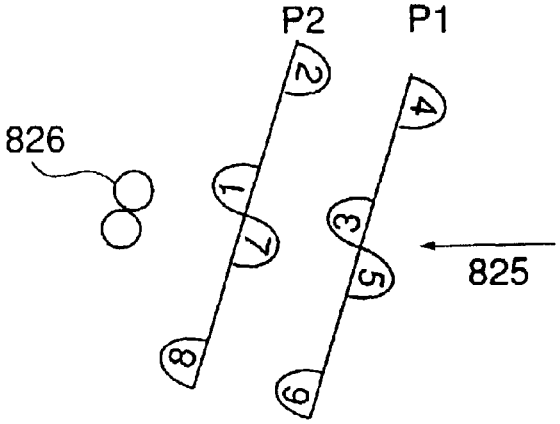

The sheets P1, P2 are each guided via the book-binding path 553 in the finisher 500 to the receiving guide 820 and stored therein. As shown in FIG. 14D, the receiving guide 820 is constructed such that the sheet P1 is received on the side of the thrusting member 825 and the sheet P2 is received on the side of folding roller pair 826. Each of the sheets P1, P2 is received with the first surface facing toward the thrusting member 825.

Positioning of the sheets P1, P2 in the receiving guide 820 is performed by the positioning member 823.

Conveyance of sheets from the inserter 900 and the printer 300 to the receiving guide 820 in the finisher 500 in the book-binding mode will now be explained with reference to FIGS. 15A to 21 which are views useful in explaining a flow of sheets from the inserter and the printer to the receiving guide in the finisher in the book-binding mode of the image forming apparatus of FIG. 1, and FIG. 22 shows an example of book-binding by the folding operation and the binding operation in the finisher of FIG. 5.

Figure 15A:
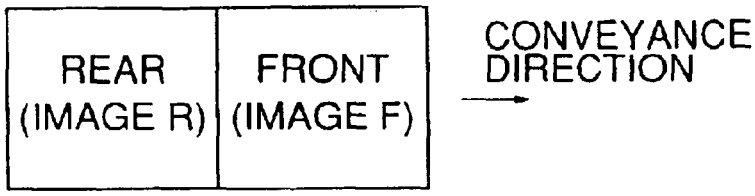
FIG. 15 is a view useful in explaining a flow of sheets from the inserter and the printer to a receiving guide in the finisher in the book-binding mode of the image forming apparatus of FIG. 1.
Figure 15B:
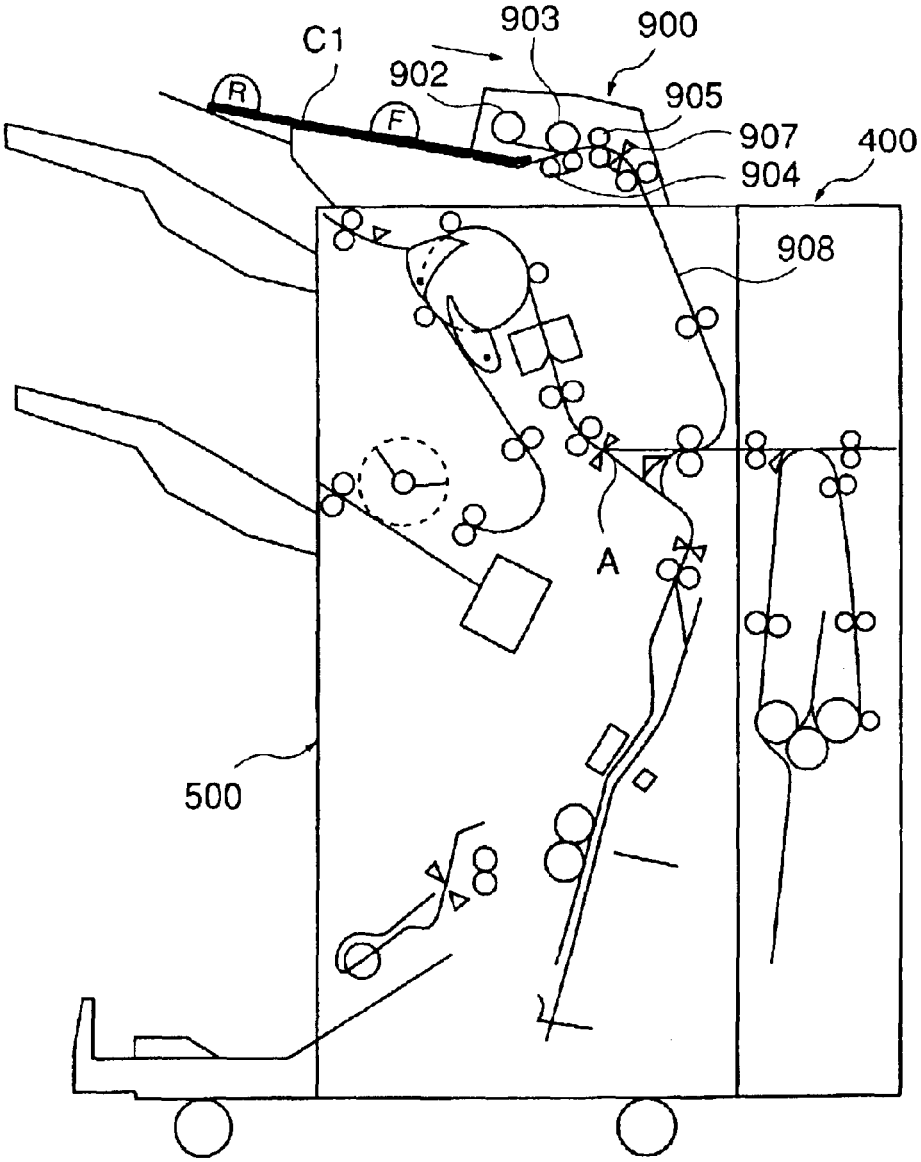

When the sheet C is to be inserted as a cover sheet into sheets with images formed thereon for book-binding, the sheet C is set on the tray 901 of the inserter 900 as shown in FIG. 15B. On this occasion, as shown in FIG. 15A, the sheet C is set on the tray 901 with a surface thereof having images R and F formed thereon facing upward, and fed with the image F in the leading position. The sheet C is set in a normal vision position as viewed from the operator. This manner of setting the sheet C is the same as the manner of setting originals in the original document feeder 100, thus facilitating the setting of the sheet C.

Figure 16:
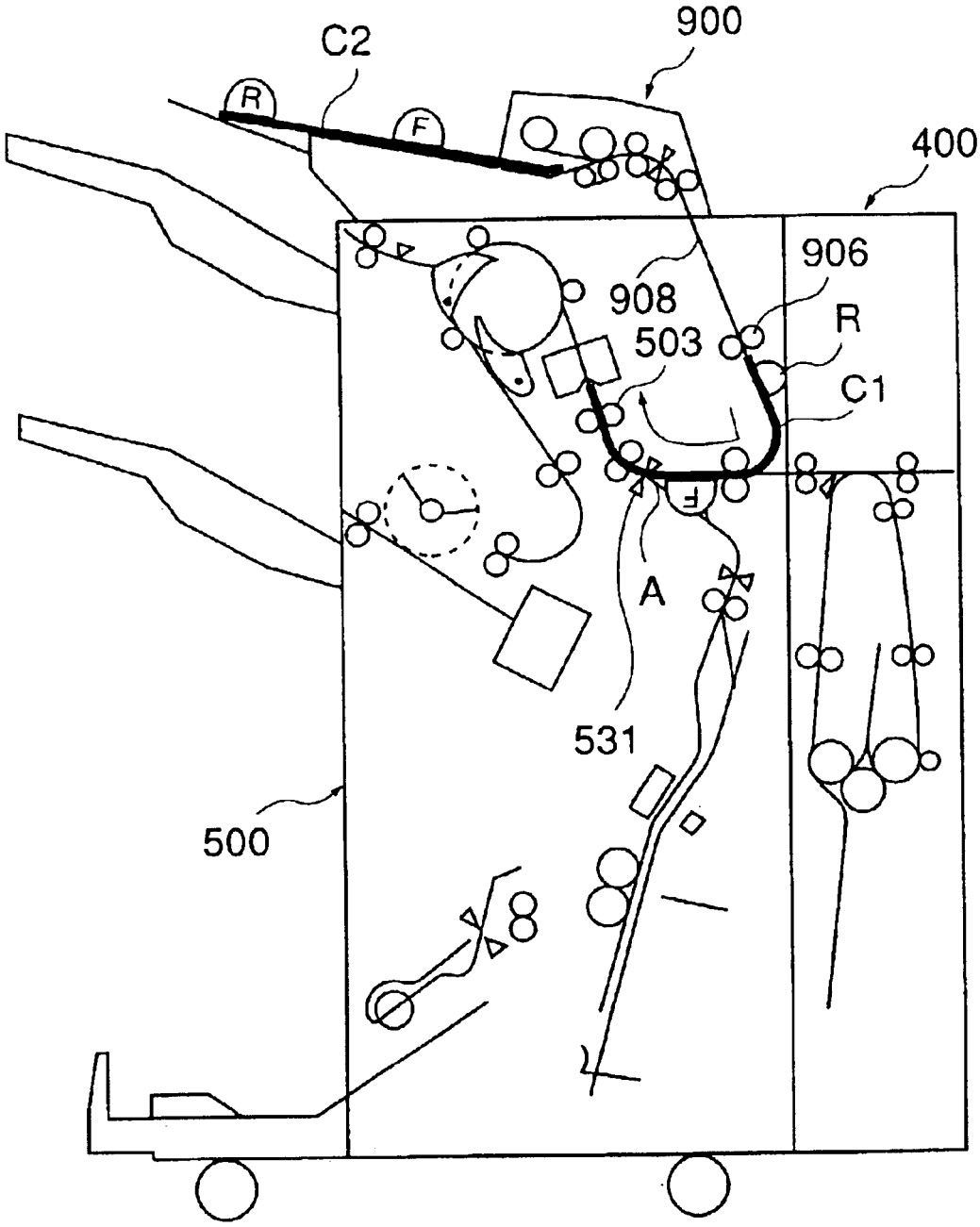
FIG. 16 is another view useful in explaining the same flow of sheets.

When a plurality of the sheets C have been set on the tray 901, and the start key, not shown, on the console unit 153 is depressed by the operator, the top sheet C1 of the sheets C starts to be fed, and the switching flapper 551 is switched to the finisher path 552 side, as shown in FIG. 16. The sheet C1 is guided through the conveyance path 908 to the finisher path 552 via the entrance roller pair 502. Upon detection of the leading edge of the sheet C1 by the entrance sensor 531, a sheet with an image formed thereon (a sheet P as shown in FIG. 17) starts to be fed from the printer 300.

Figure 17:
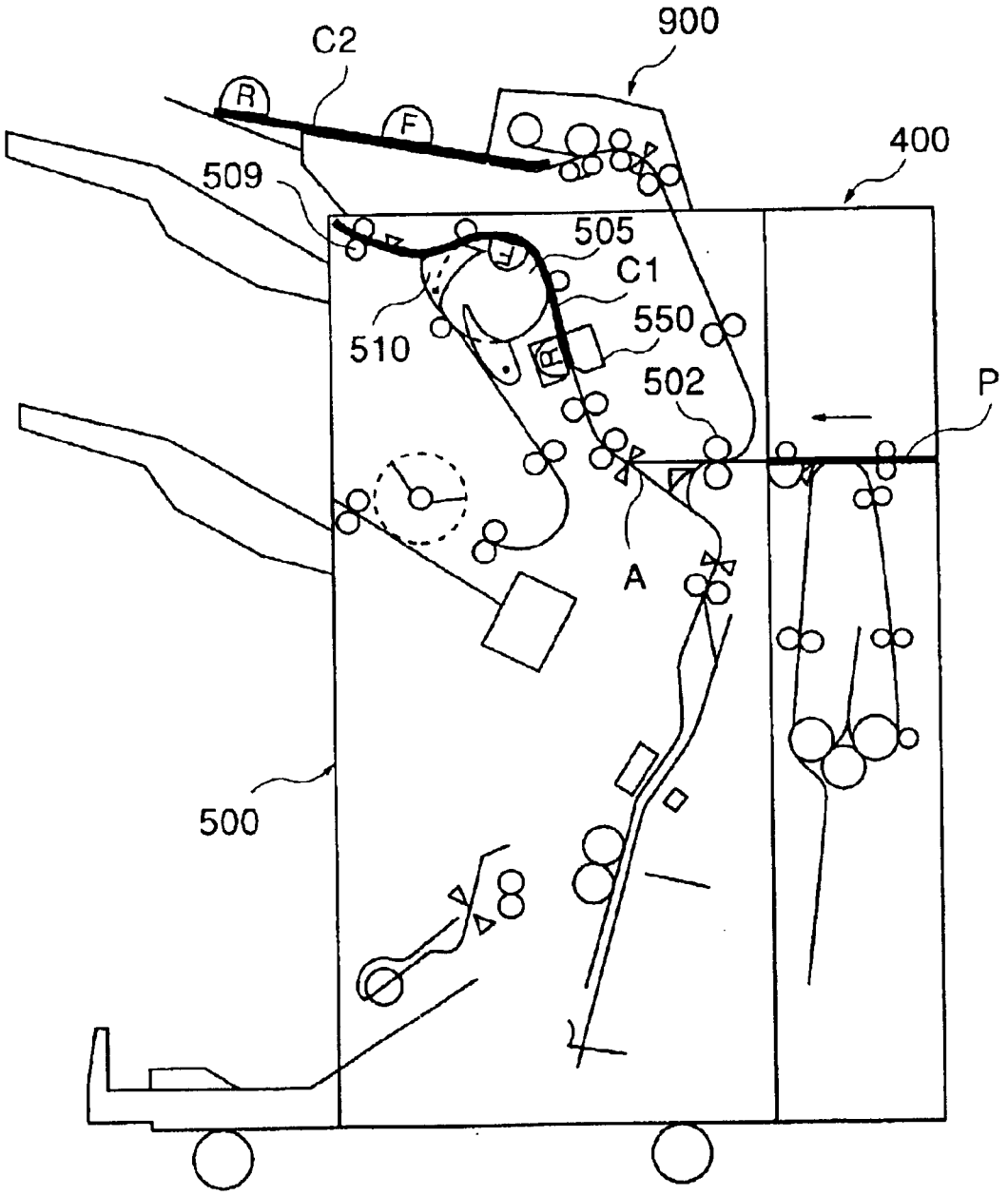
FIG. 17 is a further view useful in explaining the same flow of sheets.

Then, as shown in FIG. 17, the sheet P fed from the printer 300 is fed to the finisher 500, and the sheet C1 is fed toward the non-sort path 521 via the buffer roller 505. On this occasion, the switching flapper 510 is switched to the non-sort path 521 side.

Figure 18:
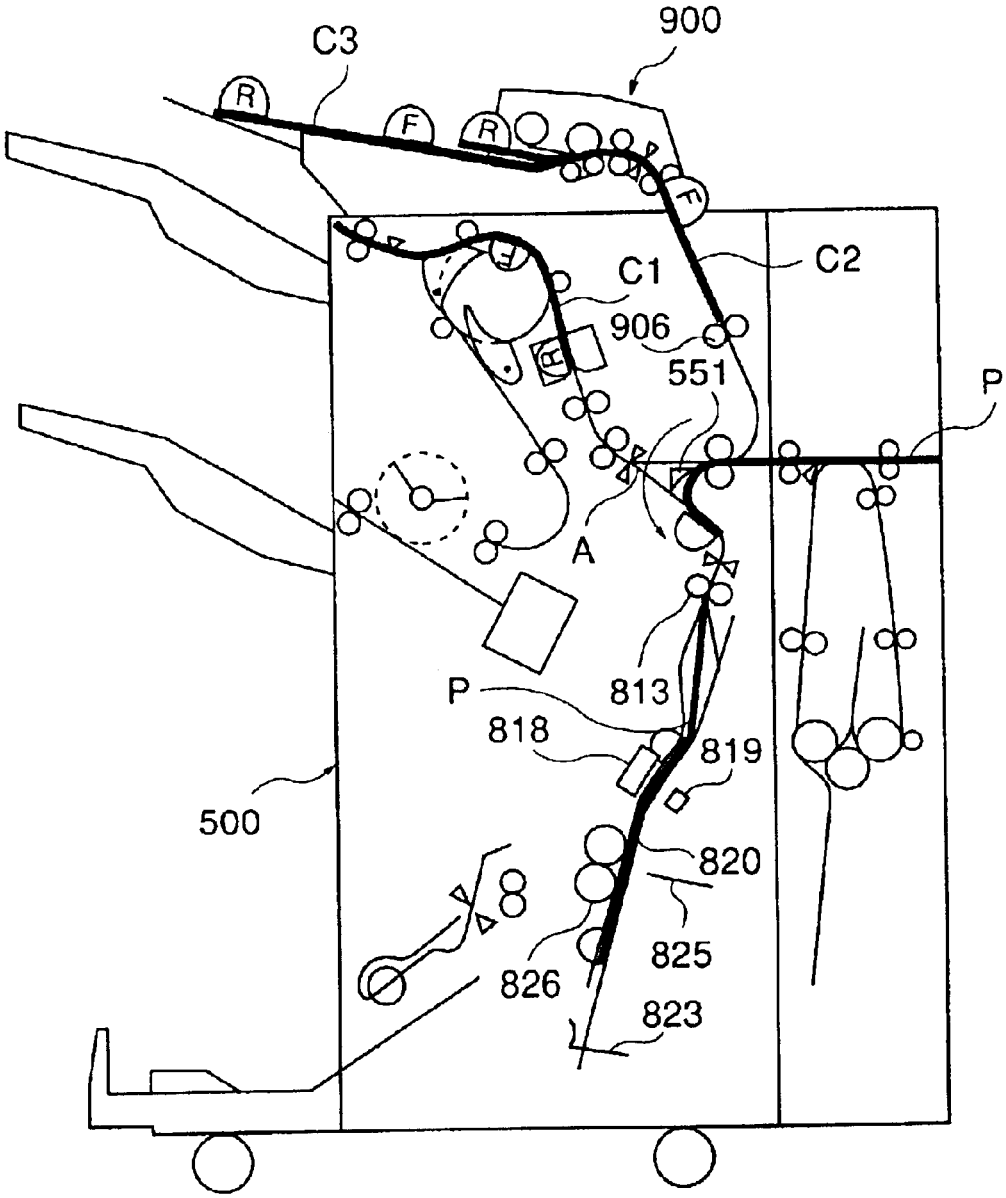
FIG. 18 is a still further view useful in explaining the same flow of sheets.

When the sheet C1 is fed toward the non-sort path 521 and conveyed to a location where the trailing edge of the sheet C1 passes the entrance sensor 531, the sheet C1 is temporarily halted, as shown in FIG. 17. At this time, the sheet P from the printer 300 is fed into the finisher 500. While the sheet C1 remains halted, the sheet P is fed by the switching flapper 551 to the book-binding path 553, and received into the receiving guide 820, as shown in FIG. 18, and then another sheet P following this sheet P is fed in the same manner as above to the book-binding path 553. If a plurality of books are to be prepared by book-binding, a sheet C2 following the sheet C1 is separated from the sheets C at this time, and conveyed to a point just before the conveyance roller pair 906, where it is kept on standby until a predetermined number of sheets are received by the receiving guide 820 (in this case, it is kept on standby until all the sheets for one job are discharged from the image forming apparatus main body and received by the receiving guide 820, and subsequently the sheet C1 is received by the guide 820).

Figure 19:
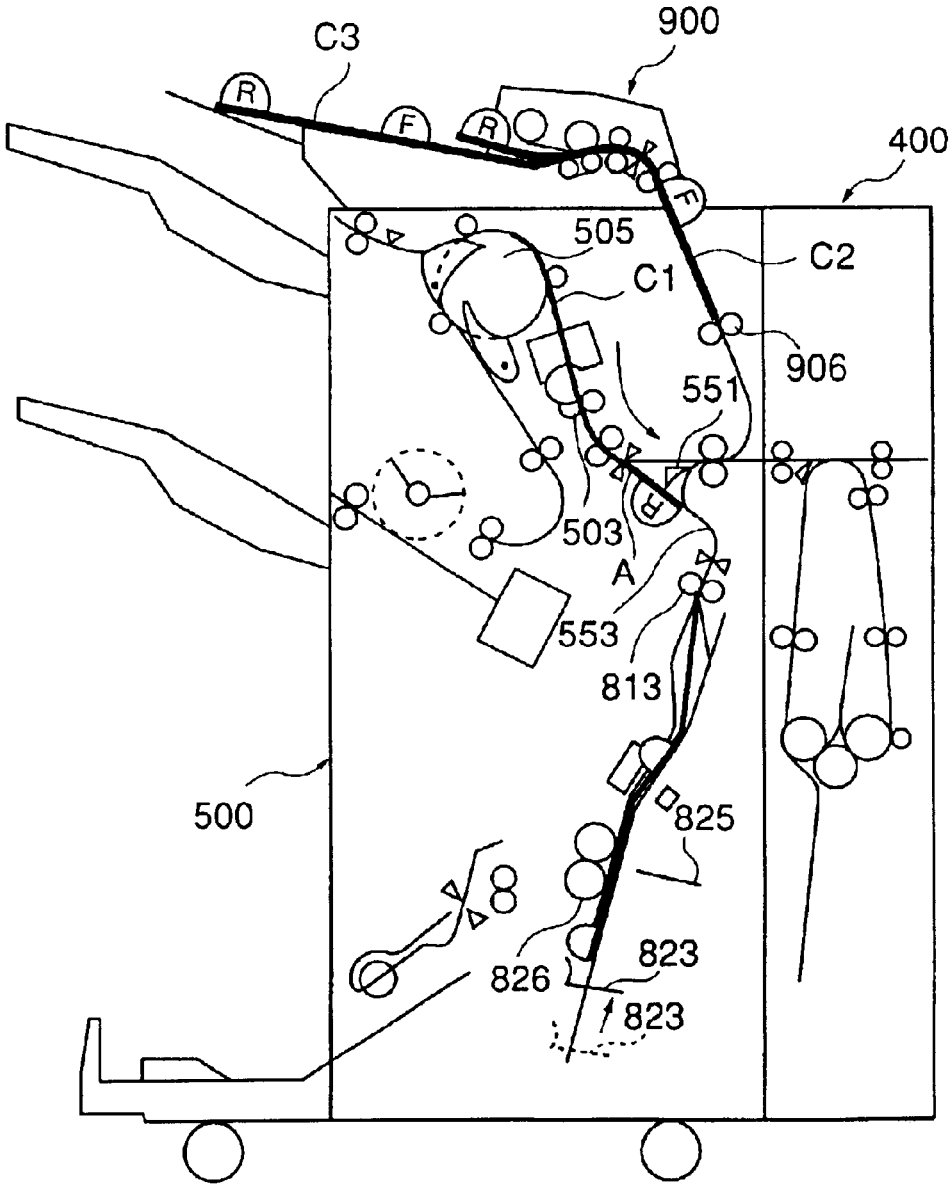
FIG. 19 is another view useful in explaining the same flow of sheets.
Figure 20:
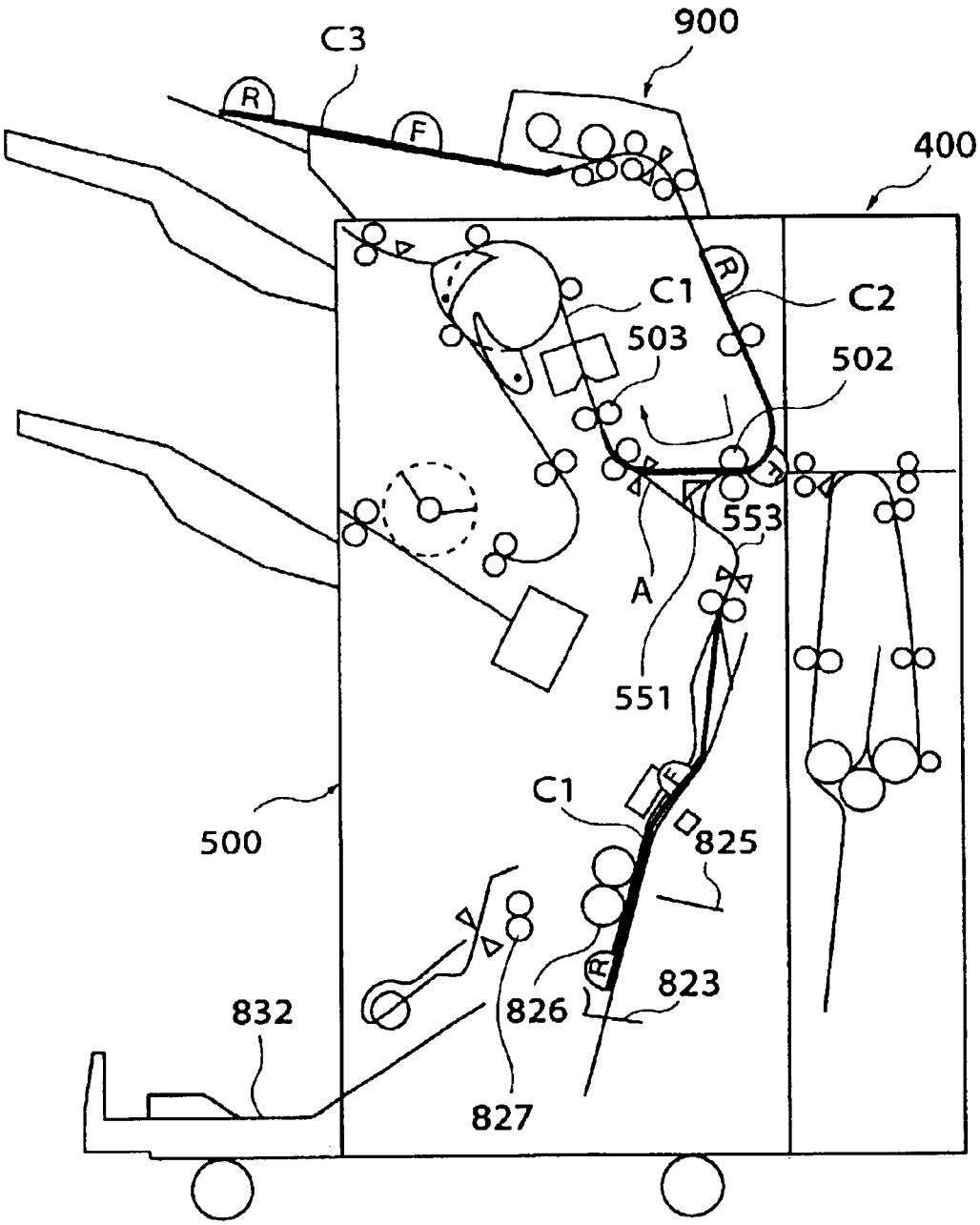
FIG. 20 is a further view useful in explaining the same flow of sheets.
Figure 21:
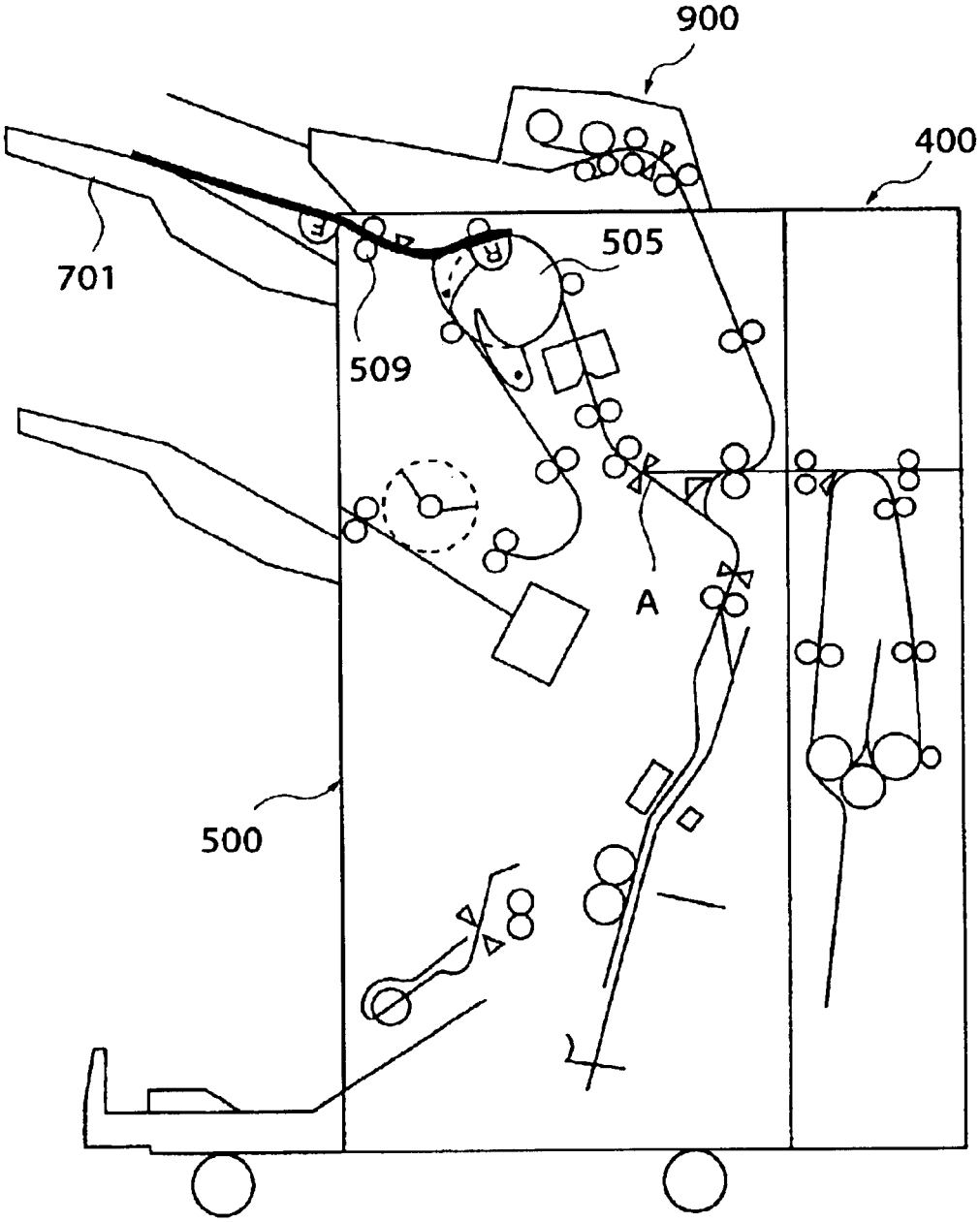
FIG. 21 is a still further view useful in explaining the same flow of sheets.
Figure 22A:
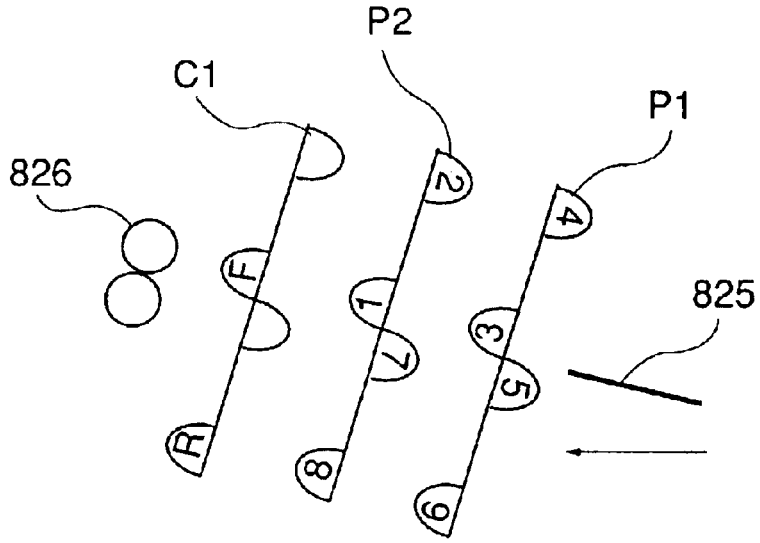
FIG. 22 is a view showing an example of manner of book-binding by folding operation and binding operation in the finisher of FIG. 5.

When a predetermined number of sheets are received by the receiving guide 820 (in this case, when all the sheets for one job are discharged from the image forming apparatus main body and received by the receiving guide 820), the sheet C1 is fed in an inverted manner (that is, switched back) into the receiving guide 820 via the branch A and the book-binding path 554, as shown in FIG. 19. At this time, as shown in FIG. 20, the sheet C1 is conveyed with its side formed with the image R in the leading position, and received by the receiving guide 820 where it is stacked on the bundle of sheets P that have already been received. Upon reception of the sheet C1 by the receiving guide 820, the sheet C2 following the sheet C1 starts to be fed. When the sheet C2, for example, is an unsuitable sheet having a size different from the desired size, the sheet C2 is not halted in the position as shown in FIG. 18, but is directly discharged to the sample tray 701, as shown in FIG. 21.

Figure 22B:
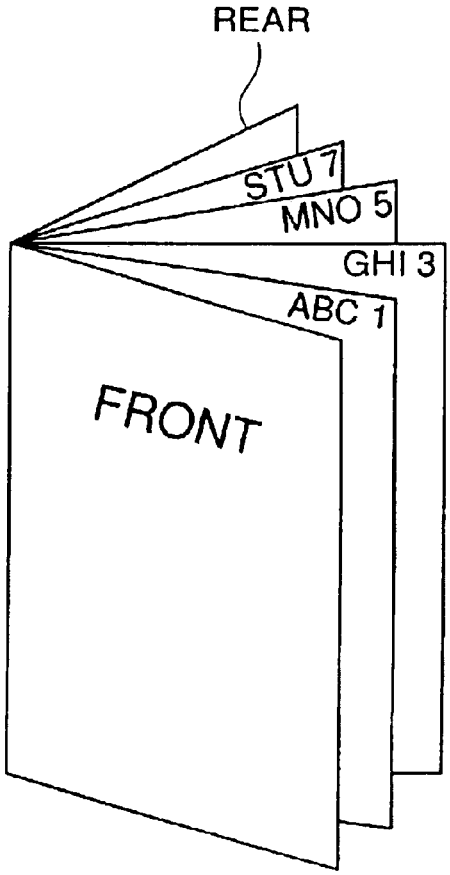

After the sheet C1 is received and stacked on the bundle of sheets P in the receiving guide 820, the thrusting member 825 is pushed out against the bundle of the sheet C1 and sheets P, so that the bundle is pushed out toward the folding roller pair 826. This bundle is folded by the folding roller 826 at the center of the bundle (at the boundary between the images of the image-formed surface), and is discharged to the saddle discharging tray 832. With the bundle thus folded, as shown in FIG. 22B, the image F of the sheet C1 is arranged on the surface page and the image R is arranged on the last page. The images on the sheets P are arranged in page order, and the images on the sheets C1 and P are oriented in the same direction.

In this manner, by controlling the sheet feed of the sheet C1 from the inserter 900 and controlling the conveyance of the sheet P from the printer 300 in the book-binding operation, the image F on the sheet C1 is arranged on the surface page, the image R is arranged on the last page, the images on the sheets P are arranged in page order, and the images on the sheets C1 and P are oriented in the same direction. Therefore, the ordinary sheets and the special sheet can be bound together without degrading the printing quality of the special sheet from the inserter 900 and without impairing the durability of conveyance of the sheets from the printer 300. Further, in this sort mode, the finisher 500 operates such that the special sheet is fed to the finisher path 552 and kept on standby, then the sheets P are fed to and received by the receiving guide 820, and subsequently the special sheet on standby in the finisher path 552 is fed to and received by the receiving guide 820. As a result, the productivity or efficiency of the book-binding operation of binding together ordinary sheets and special sheets can be improved.

If required (for example, when stapling is performed in the book-binding mode), after the sheet C1 is received by the receiving guide 820 and stacked on the bundle of sheets P, the bundle of sheets P and C may be bound by the stapler 818 at its center.

Next, the control process performed by the finisher 500 will be described with reference to FIGS. 23 to 29. This control process is performed by the CPU circuit block 510 based on instructions from the CPU circuit block 150. The program for performing this control process is stored in the ROM 512.

First, a mode discriminating process will be described with reference to FIG. 23 which is a flow chart showing the mode discriminating process by the finisher 500 of the image forming apparatus of FIG. 1.

Figure 23:
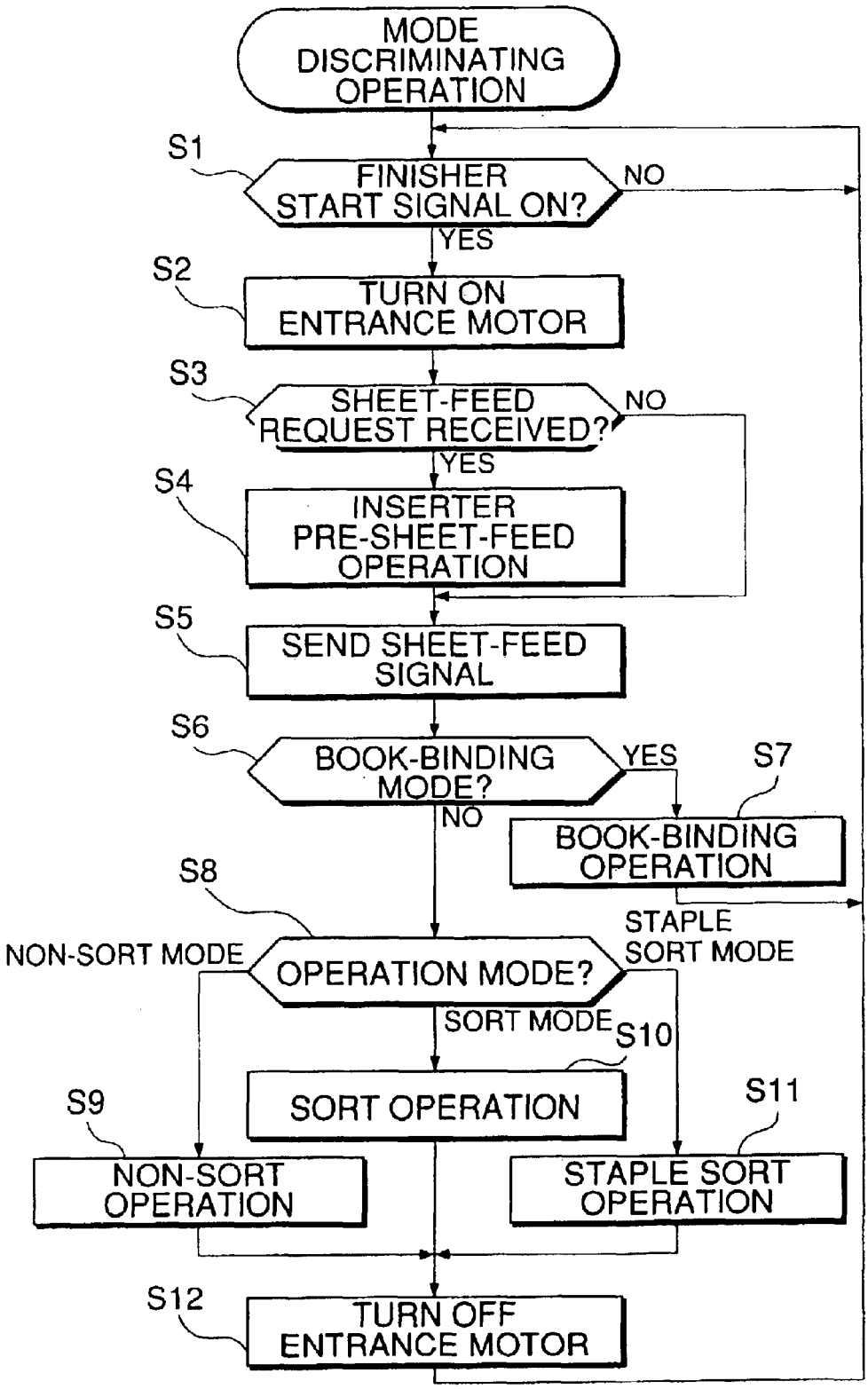
FIG. 23 is a flow chart showing a mode discriminating process performed by the finisher of the image forming apparatus of FIG. 1.

In the mode discriminating process, as shown in FIG. 23, in step S1, the finisher 500 waits for a finisher start signal which instructs initiation of the operation of the finisher 500 to be generated. This start signal is generated by the CPU circuit block 150 and delivered to the finisher controller 501 upon depression of a start key on the console unit 153 that instructs initiation of copying. The finisher 500 is kept on standby until this start signal is generated.

When the start signal is generated and delivered to the finisher 500, the process proceeds to step S2, where driving of the entrance motor M1 is started. In the following step S3, it is determined whether data from the communication IC 514 contains a sheet-feed request to the inserter 900 or not. A command for this sheet-feed request is sent to the finisher control unit 501 of the finisher 500 when the "inserter" key is selected on the screen view for setting cover insertion as shown in FIG. 7B.

If the data contains a sheet-feed request, the process proceeds to step S4, where an inserter pre-sheet-feed process, described later, is performed. Then, the process proceeds to step S5. On the other hand, if the data contains no sheet-feed request, the process skips over the step S4 to step S5, where a sheet-feed signal (signal to urge the permission of image forming operation) is sent from the CPU circuit block 510 to the CPU circuit block 150 of the image forming apparatus main body 10 via the communication IC 514. Upon receiving the sheet-feed signal, the CPU circuit block 150 performs control for starting the image forming operation.

Then, the process proceeds to step S6. In step S6, it is determined based on post-processing mode data sent from the CPU circuit unit 150 via the communication IC 514 whether the set operation mode is the book-binding mode or not. The above-mentioned post-processing mode menu screen view as shown in FIG. 7A is used for setting the operation mode. If it is determined that the set operation mode is the book-binding mode, the process proceeds to step S7, where the book-binding operation, described later, is performed, and then the process returns to the step S1.

If the set operation mode is not the book-binding mode, the process proceeds to step S8, where it is determined which of the non-sort mode, sort mode or staple sort mode has been set.

If the set operation mode is the non-sort mode, the process proceeds to step S9, where a non-sort operation is performed. If the set operation mode is the sort mode, the process proceeds to step S10, where a sort operation is performed. If the set operational mode is the staple sort mode, the process proceeds to step S11, where a staple sort operation is performed. When the corresponding operation has been performed, the process proceeds to step S12, where the entrance motor M1 is turned off, and the process returns to the above-mentioned step S1 to again wait for the finisher start signal to be generated.

When the inserter-sheet-feed request is issued, the inserter pre-sheet-feed operation in step S4 is performed in each of the operations of step S7, step S9, step S10, and step S11 as well at the start of bundle processing.

Next, the non-sort operation in the above-mentioned step S9 will be described with reference to FIG. 24, which is a flow chart showing the process of non-sort operation in the above-mentioned step S9 of FIG. 23.

Figure 24:
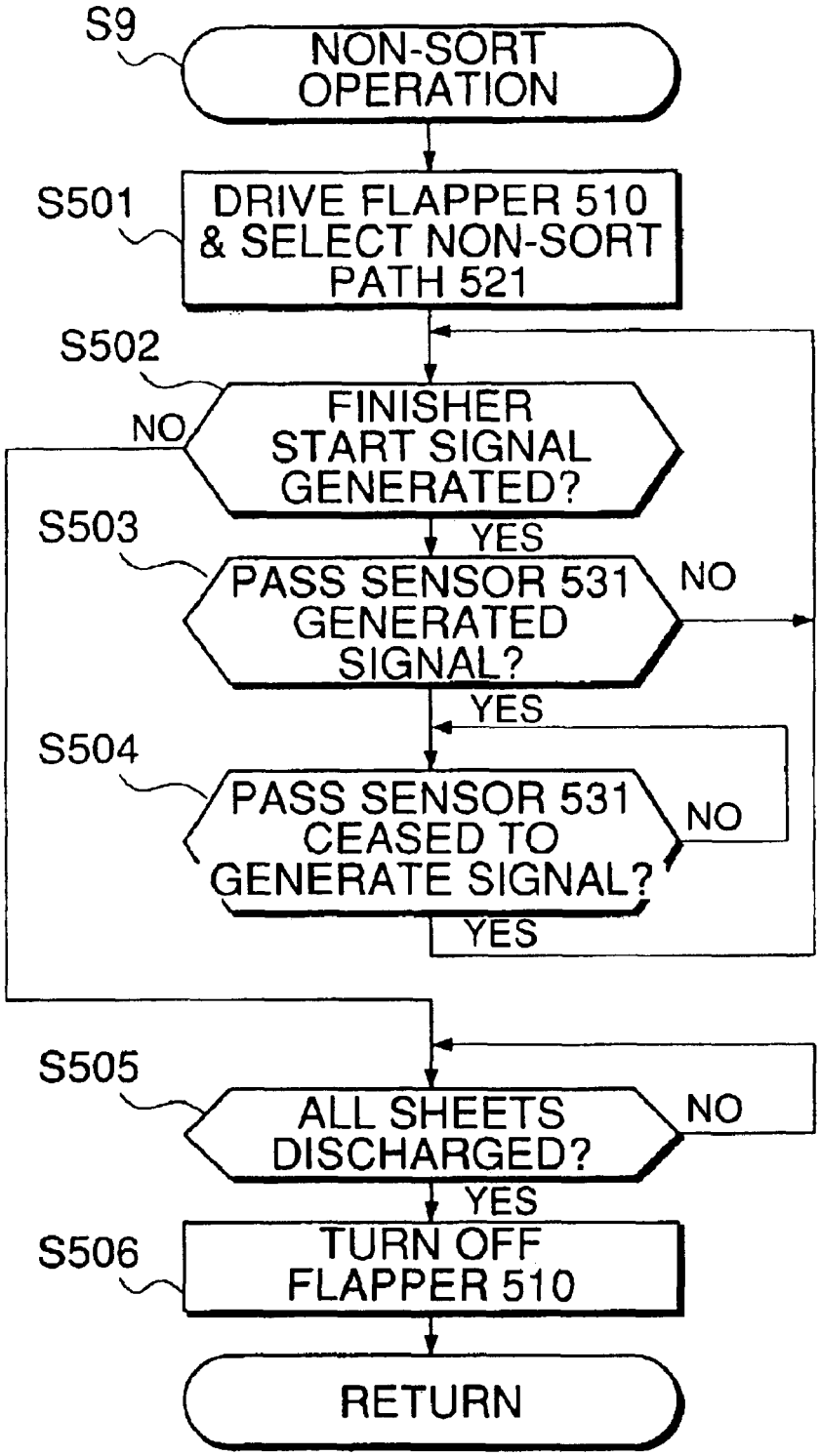
FIG. 24 is a flow chart showing a non-sort process executed in a step S9 of FIG. 23.

In the non-sort operation, as shown in FIG. 24, in step S501 the switching flapper 510 is operated to select the non-sort path 521. On this occasion, the finisher path 552 has been selected by the switching flapper 551. In the following step 502, it is determined whether the finisher start signal to the finisher 500 has been generated or not. If the finisher start signal has been generated, which means that a sheet discharged from the printer 300 has been conveyed into the finisher 500, it is determined in step 503 whether the pass sensor 531 has generated an output signal or not. If the pass sensor 531 has not generated the output signal, the process returns again to the above-mentioned step S502. On the other hand, if the pass sensor 531 has generated the output signal, judging that the leading edge of the sheet conveyed into the finisher 500 has reached the pass sensor 531, the buffer motor M2 and sheet discharging motor M3 are started. Then, the process proceeds to step S504 to wait for the sheet to pass through the pass sensor 531. When the pass sensor 531 has ceased to generate the output signal, judging that the sheet has passed the pass sensor 531, the process returns again to the above-mentioned step S502, followed by resuming the monitoring of the conveyance of sheet using the pass sensor 531.

If it is determined in the above-mentioned step S502 that the finisher start signal has been stopped, judging that the image formation has been completed in the printer 300, the process proceeds to step S505, to wait for all the sheets to be discharged onto the sample tray 701. When all the sheets have been discharged, the process proceeds to step S506, where the flapper 510 is stopped and the buffer motor M2 and sheet discharging motor M3 are stopped, followed by terminating the present process.

Next, the sort operation in the above-mentioned step S10 of FIG. 23 will be described with reference to FIG. 25, which is a flow chart showing the process of sort operation in the step S10 of FIG. 23.

Figure 25:
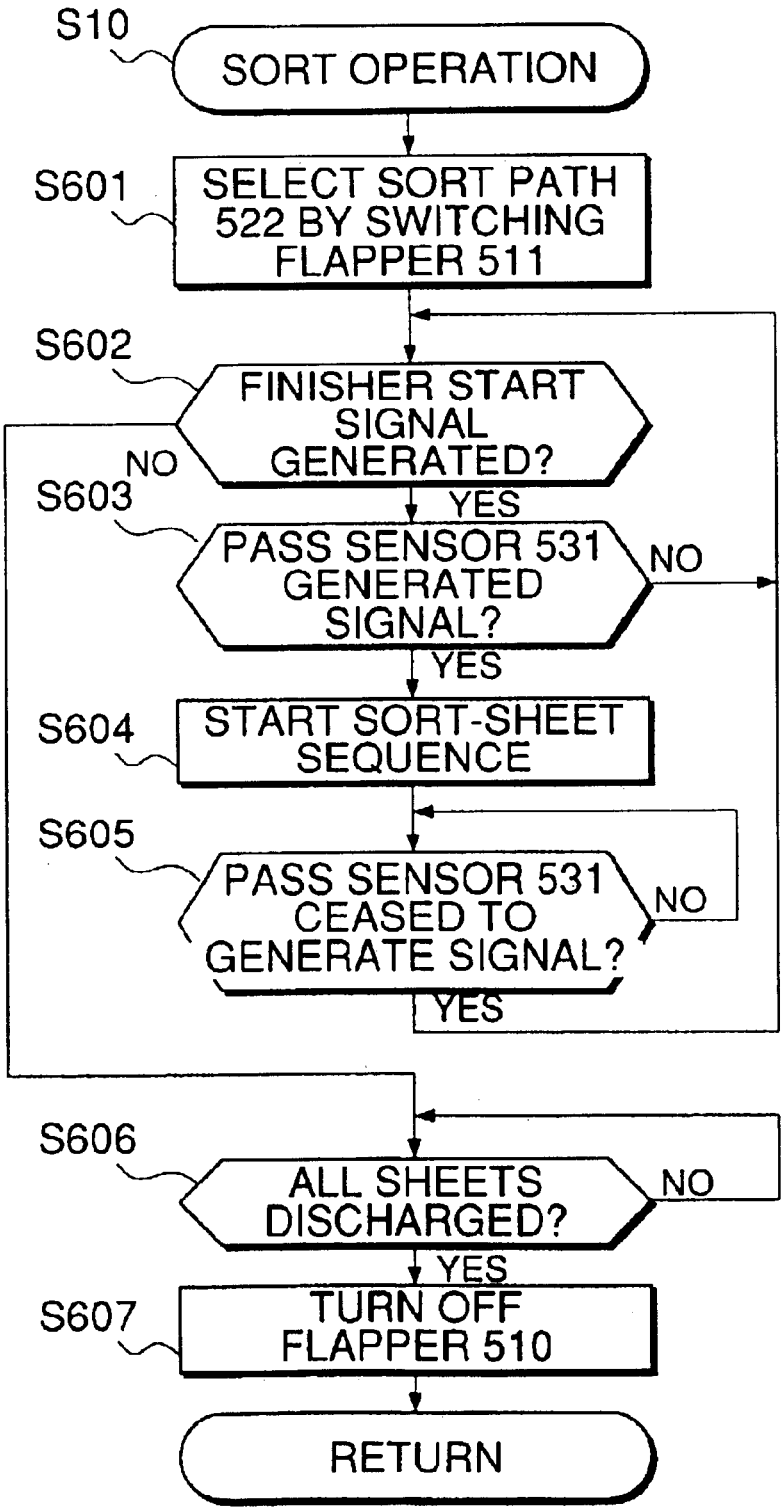
FIG. 25 is a flow chart showing a sort process executed in a step S10 of FIG. 23.

In the sort operation, as shown in FIG. 25, first in step S601, the flapper 511 is operated to select the sort path 522. On this occasion, the finisher path 552 has been selected by the switching flapper 551. In the following step S602, it is determined whether the finisher start signal has been generated or not. When the finisher start signal has been generated, which means that a sheet discharged from the printer 300 has been conveyed into the finisher 500, it is determined in step S603 whether the pass sensor 531 has generated the output signal or not, and if the pass sensor 531 has not generated the signal, the process returns again to the above-mentioned step S602.

On the other hand, if the pass sensor 531 has generated the signal, judging that the leading edge of the sheet conveyed into the finisher 500 has reached the pass sensor 531, the process proceeds to step 604, where a sort-sheet sequence is started. The sort-sheet sequence is a sequence of operations that are performed as multi-task processing by the CPU 511 of the CPU circuit block 510 such that the start and stop of the buffer motor M2 and the speed of the sheet discharging motor M3 are controlled so as to expand the intervals between sheets, an aligning operation for each sheet is performed by an aligning member, not shown, provided in the processing tray 630, and when the stacking of sheets into a bundle on the processing tray 630 is completed, the bundle is discharged onto the stack tray 700.

In the following step S605, the process waits for the pass sensor 531 to stop generating the output signal. When the pass sensor 531 has stopped generating the signal, judging that the sheet has passed the sensor 531, the process returns to the above-mentioned step S602, followed by resuming the monitoring of the conveyance of sheet using the pass sensor 531.

If it is determined in the above-mentioned step S602 that the finisher start signal has ceased to be generated, judging that the image formation in the printer 300 has been completed, the process proceeds to step S606 to wait for all the sheets to be discharged onto the stack tray 700. When all the sheets have been discharged, the process proceeds to step 607, where the flapper 611 is stopped, followed by terminating the present process.

Next, the staple sort operation in the above-mentioned step S11 of FIG. 23 will be described with reference to FIG. 26, which is a flow chart showing the process of the staple sort operation in the step S11 of FIG. 23.

Figure 26:
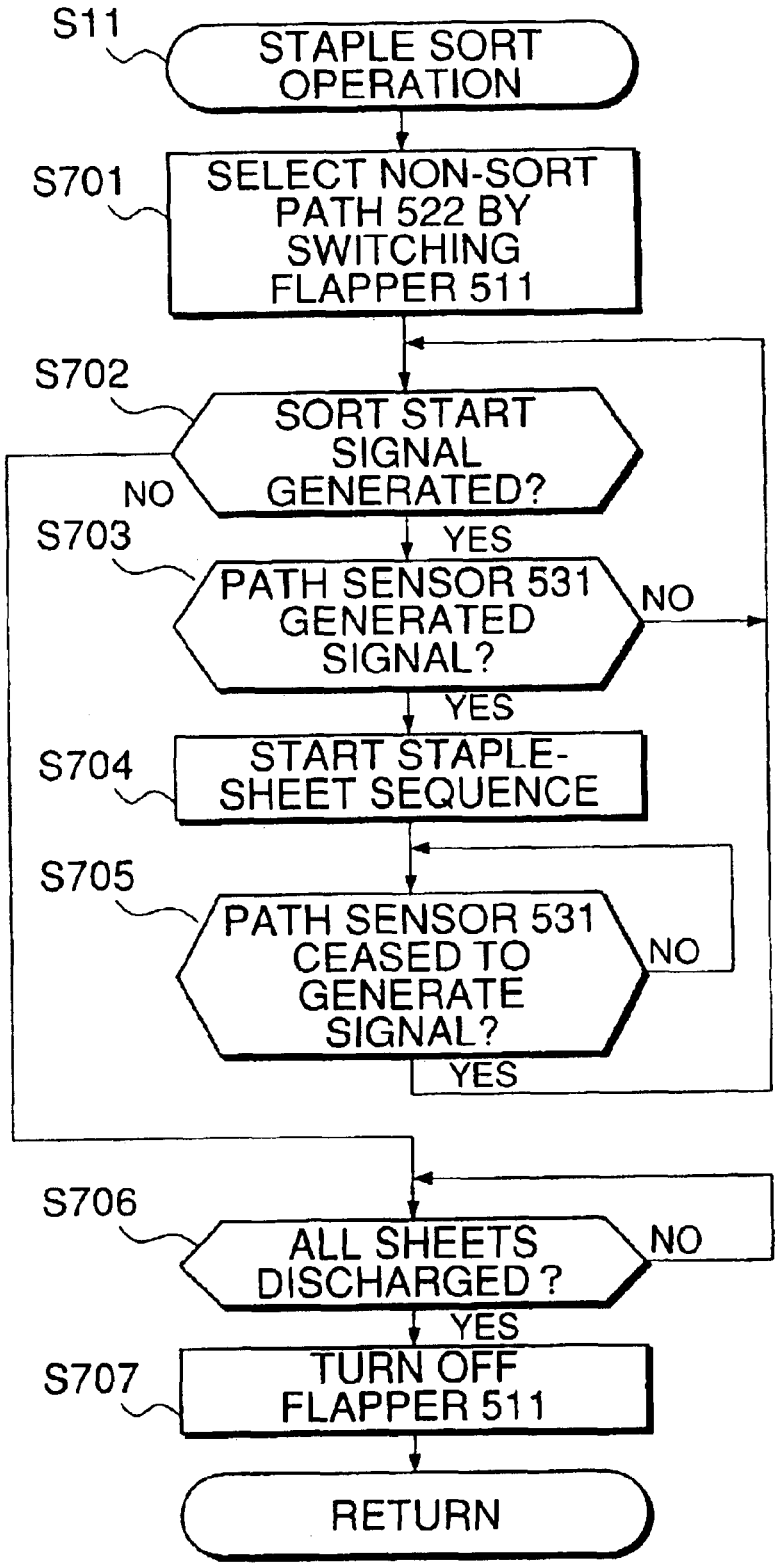
FIG. 26 is a flow chart showing a staple sort process executed in a step S11 of FIG. 23.

In the staple sort operation, as shown in FIG. 26, the flapper 511 is operated in step S701 to select the sort path 522. On this occasion, the finisher path 552 has been selected by the flapper 551. In the following step S702, it is determined whether the finisher start signal to the finisher 500 has been generated or not. It the finisher start signal has been generated, which means that the sheet discharged from the printer 300 has been conveyed into the finisher 500, it is determined in step S703 whether the pass sensor 531 has generated the output signal or not. If the pass sensor 531 has not generated the output signal, the process returns again to the above-mentioned step S702.

On the other hand, if the pass sensor 531 has generated the output signal, judging that the leading edge of the sheet conveyed into the finisher 500 has reached the pass sensor 531, the process proceeds to step S704, where the staple-sheet sequence is started. This staple-sheet sequence is a sequence of operations that are performed as multi-task processing by the CPU 511 of the CPU circuit unit 510 such that the start and stop of the buffer motor M2 and the speed of the sheet discharging motor M3 are controlled so as to expand the intervals between sheets, an aligning operation for each sheet is performed by an aligning member, not shown, provided in the processing tray 630, and when the stacking of sheets into a bundle on the processing tray 630 is completed, the staple operation is performed at a predetermined position, and the bundle is discharged onto the stack tray 700.

Then, in the following step S705, the process waits for the pass sensor 531 to generate the output signal. When the pass sensor 531 has ceased to generate the output signal, judging that the sheet has passed through the pass sensor 531, the process returns to the above-mentioned step S702, followed by resuming the monitoring of conveyance of sheets.

If in the above-mentioned step S702 it is determined that the finisher start signal ceased to be generated, judging that the image formation in the printer 300 has been finished, the process proceeds to step S706, where the process waits until all the sheets are discharged onto the stack tray 700. When all the sheets have been discharged, the process proceeds to step S707 to stop the flapper 511, followed by terminating the present process.

Next, the inserter pre-sheet-feed operation in the step S4 of FIG. 23 will be described with reference to FIG. 27, which is a flow chart showing the process of the inserter pre-sheet-feed operation in the step S4 of FIG. 23.

Figure 27:
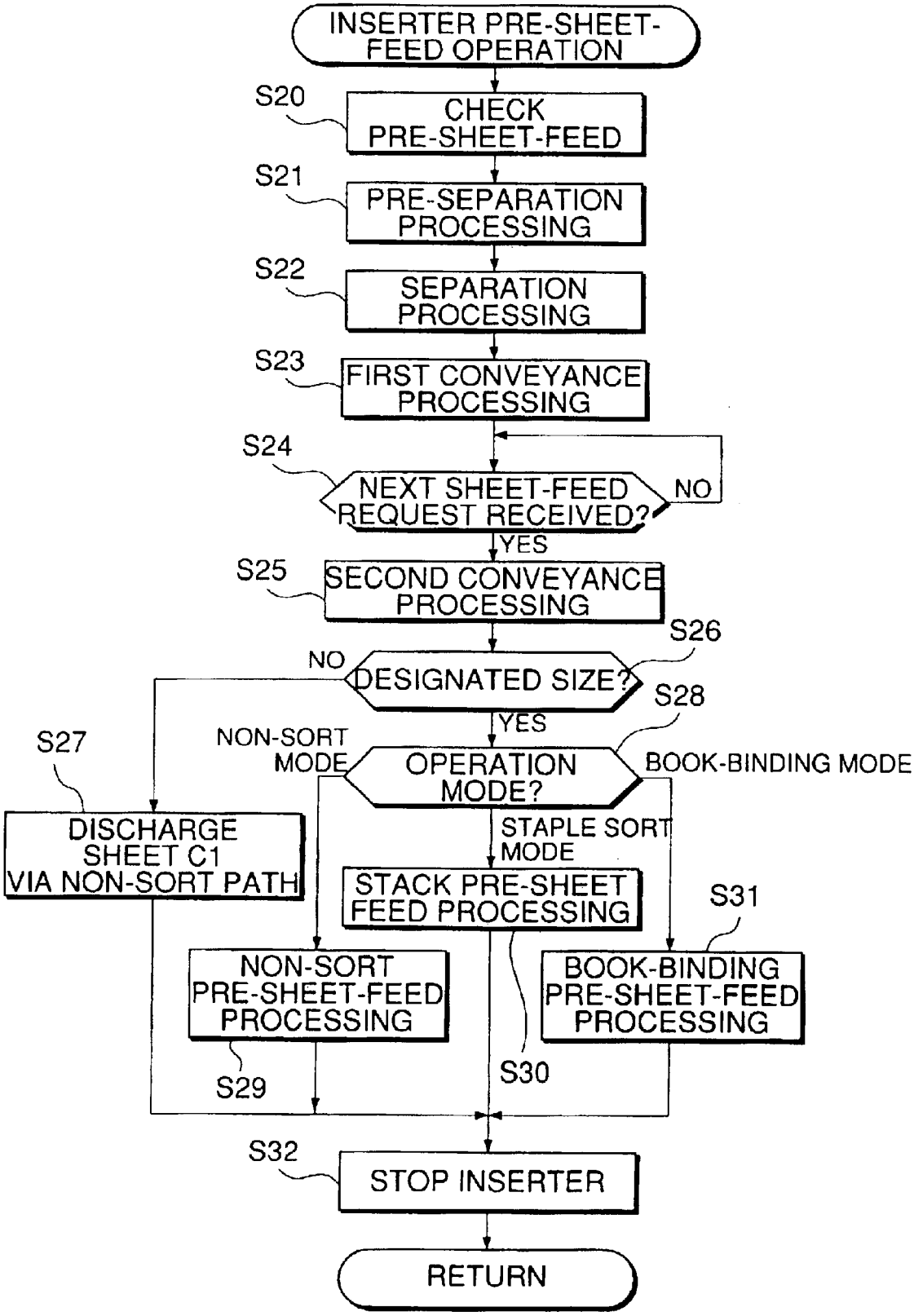
FIG. 27 is a flow chart showing an inserter sheet-prefeeding process executed in a step S4 of FIG. 23.

In the inserter pre-sheet-feed operation, as shown in FIG. 27, a pre-sheet-feed check is first performed in step S20. In this pre-sheet-feed check, the presence of the bundle of sheets C on the tray 901 of the inserter 900 is checked, a pre-sheet-feed check as to sheet designation data from the console unit 153 of the image forming apparatus main body 10 and so forth is performed, and an image formation inhibiting signal is sent to the CPU circuit block 150 of the image forming apparatus main body 10.

If it is confirmed by the pre-sheet-feed check that the sheet-feed conditions for feeding sheets from the inserter 900 are satisfied, the process proceeds to step S21, and a sequence of pre-separation processing is performed. More specifically, after a sheet-feed shutter, not shown, is drawn by turning on the shutter solenoid SL20, the sheet feed roller 902 is lowered until it is placed onto the bundle of sheets C by turning on the pickup solenoid SL21. At the same time, by turning on the sheet-feed clutch CL10, the driving force of the sheet-feed motor M20 is transmitted to the sheet feed roller 902.

In the following step S22, the driving of the sheet-feed motor M20 is started after the lapse of a predetermined period of time, and the separation roller 903, the separation belt 904, and the sheet-feed roller pair 905 are caused to rotate. Consequently, the top sheet C1 of the bundle of sheets C is separated and fed to the conveyance path 908.

Then, the process proceeds to step S23, where first conveyance processing is performed. In the first conveyance processing, the conveyance status of the sheet C1 is monitored by the sheet feed sensor 907, and when the leading edge of the sheet C1 is detected by the sheet-feed sensor 907, the sheet-feed clutch CL10 is turned off and counting of a clock by a clock sensor provided in the sheet-feed motor M20 is started. When the count value reaches a predetermined value N1, the sheet-feed motor M20 is turned off to temporarily halt the sheet C1 just before the conveyance roller pair 906.

Then, the process proceeds to step S24, to wait for the next sheet-feed request for the sheet C1 to be fed to the inserter 900 from the CPU circuit block 150 of the image forming apparatus main body 10 upon the completion of the sheet feed. If the next sheet-feed request is issued, the process proceeds to step S25, where second conveyance processing is performed. In the second conveyance processing, the driving of the sheet-feed motor M20 is restarted, and at the same time the buffer motor M2 and the sheet discharging motor M3 are turned on. When the sheet feed sensor 907 detects the trailing edge of the sheet C1, the counting operation is terminated and the length of the sheet C1 in the conveyance direction is calculated from the count value. In the following step S26, it is determined whether the calculated length of the sheet C1 in the conveyance direction coincides with the designated size obtained in the above-mentioned step S20 or not. If the two values do not coincide, the process proceeds to step S27, where the switching flapper 510 is switched to the non-sort path 521 side to discharge the sheet C1 onto the sample tray 701 via the non-sort path 521. At the same time, a warning to the effect that an unsuitable sheet has been set is issued to the CPU circuit block 150 of the image forming apparatus main body 10. Then, the process proceeds to step S32, where inserter-stop processing is performed. In this processing, the image formation inhibiting signal is canceled, the sheet-feed motor M20 is turned off, and the presence or absence of a sheet is checked by a sheet set sensor, not shown, to detect sheet(s) on the tray 901 of the inserter 900. If there is no sheet, the shutter solenoid SL20 is kept on, followed by terminating the present process.

On the other hand, if the calculated length of the sheet C1 in the conveyance direction coincides with the above-mentioned designated size obtained in step S20, !that is, if the sheet C1 is a sheet of the proper size, the process proceeds to step S28, where the set operation mode is discriminated. If the operation mode is the non-sort mode, the process proceeds to step S29, where the non-sort pre-sheet-feed processing is performed. In this processing, the sheet C1 is discharged to the sample tray 701. In the next step S32, the inserter-stop processing is performed, followed by terminating the present process.

If the set operation mode is the sort mode or the staple sort mode, the process proceeds to step S30, where stack pre-sheet-feed processing is performed. In this processing, the switching flapper 510 and the switching flapper 511 are switched to the sort path 522 side so that the sheet C1 is fed to the processing tray 630. On the processing tray 630, an aligning process is performed to align the sheets of the bundle stacked on the tray, and after the following sheet has been stacked, a binding operation is performed to bind the bundle of sheets with the stapler 601, to enable a book-binding operation. On the processing tray 630, the sheet C1 is stacked with its image-formed surface facing downward. Then, the process proceeds to step S32, where the inserter-stop processing is performed, followed by terminating the present process.

If the set operation mode is the book-binding mode, the process proceeds to step S31, where book-binding pre-sheet-feed processing is performed. In this processing, the switching flapper 510 is switched to the non-sort path 521 side, to guide the leading edge of the sheet C1 to the non-sort path 521. When the passage of the trailing edge of the sheet C1 through the conveyance roller pair 503 is detected, the driving of the buffer motor M2 and the sheet discharging motor M3 is stopped so that the sheet C1 is kept on standby in the non-sort path 521. Although the entrance motor M1 then continues to be driven, the trailing edge of the sheet C1 has passed through the conveyance roller pair 503. Accordingly, no conveying force is exerted upon the sheet C1. Then, the process proceeds to step S32, where the inserter-stop processing is performed, followed by terminating the present process.

Next, the book-binding operation in the step S7 of FIG. 23 will be described with reference to FIG. 28, which is a flow chart showing the process of book-binding operation in the step S7 of FIG. 23.

In the book-binding operation, as shown in FIG. 28, it is first determined in step S101 based on the size information whether the sheet conveyed from the printer 300 to the finisher 500 is of a proper size suitable for the book-binding or not. If it is determined that the size of the sheet is not suitable for the book-binding, the present process is immediately terminated. If the size of the sheet is suitable for the book-binding, the process proceeds to step S102, where an initial operation of the book-binding is performed. In the initial operation of the book-binding, the conveyance motor M10 is turned on to rotate the book-binding roller pair 813 to enable the sheet to be conveyed. At the same time, by turning on the book-binding switching solenoid SL10, the switching flapper 551 is switched to the first book-binding path 553 side so as to guide the sheet from the printer 300 to the receiving guide 820. Further, a width adjusting member, not shown, is positioned so as to provide a width larger by a predetermined margin than the width of the sheet, and the positioning motor M11 is rotated a predetermined number of steps so as to make the distance between the sheet positioning member 823 and the staple position of the stapler 818 equal to ½ of the length of the sheet in the conveyance direction.

Then, the process proceeds to step S103, where it is determined based on a signal from the book-binding entrance sensor 817 whether a sheet has arrived at the receiving guide 820 or not. If no sheet has arrived, the process returns to the above-mentioned step S102. On the other hand, if a sheet has arrived at the receiving guide 820, the process proceeds to step S104, where the above-mentioned width adjusting member is operated after the lapse of a predetermined period of time to align the sheets in the direction of the width of sheets. In the following step S105, it is determined whether the sheet that has just arrived is the last sheet of the bundle corresponding to one job or not. If it is not the last sheet, the process again returns to the above-mentioned step S102, followed by repeating the process from step S102 to step 105 until the last sheet of the bundle corresponding to one job is received by the receiving guide 820. If the sheet that has just arrived is the last sheet, the process proceeds to step 106, where the image formation inhibiting signal is output to the CPU circuit block 150.

Then, the process proceeds to step S107, where it is determined whether the sheet feed from the inserter 900 is designated or not. If the sheet-feed from the inserter 900 is designated, the process proceeds to step S108, where inserter sheet-feed processing, described later, is performed, and then the process proceeds to step S109. If the sheet-feed from the inserter is not designated, the process skips over step S108 to step S109.

In step S109, staple processing using the stapler 818 is performed. In the following step S110, bundle conveyance processing is performed. In this processing, the sheet positioning member 823 is lowered, and the conveyance motor M10 is again turned on, so that the bundle of sheets is conveyed by the distance between the nip point of the folding roller pair 826 and the staple position of the stapler 818.

Then, the process proceeds to step S111, where folding control processing is performed. In this folding control processing, the folding clutch CL1 is turned on, and the folding motor M12 is turned on so that the thrusting member 825 is moved toward the folding roller pair 826 (in the direction indicated by the arrow in FIG. 22A). In this way, the center of the sheet bundle (staple position) is guided to the nip of the folding roller pair 826, where the bundle of sheets is folded in two. The thrusting member 825 is adapted to be reciprocally moved with a cam mechanism, and when a sensor, not shown, detects one cycle of motion of the thrusting member, the folding clutch CL1 is turned off.

Then, the process proceeds to step S112, to wait for the discharging of the two-folded bundle to the saddle discharging tray 832 to be completed, based on a signal from the sheet discharge sensor 830. When the discharging is completed, the process proceeds to step S113, where the driving of the folding motor M12 is stopped. Then, in step S114, it is determined whether the discharged bundle of sheets is the last bundle or not, and if this bundle of sheets is the last bundle, the process proceeds to step S115, where book-binding mode terminating processing is performed. In this processing, the above-mentioned width adjusting member and sheet positioning member 823 are retreated to their respective standby positions, the switching flapper 551 is switched to the finisher path 552 side to terminate the book-binding mode, followed by terminating the present process.

If the bundle of sheets is not the last bundle, the process proceeds to step S116, where the image formation inhibiting signal is canceled and sent to the CPU circuit unit 150. The process then returns to the above-mentioned step S102.

Figure 29:
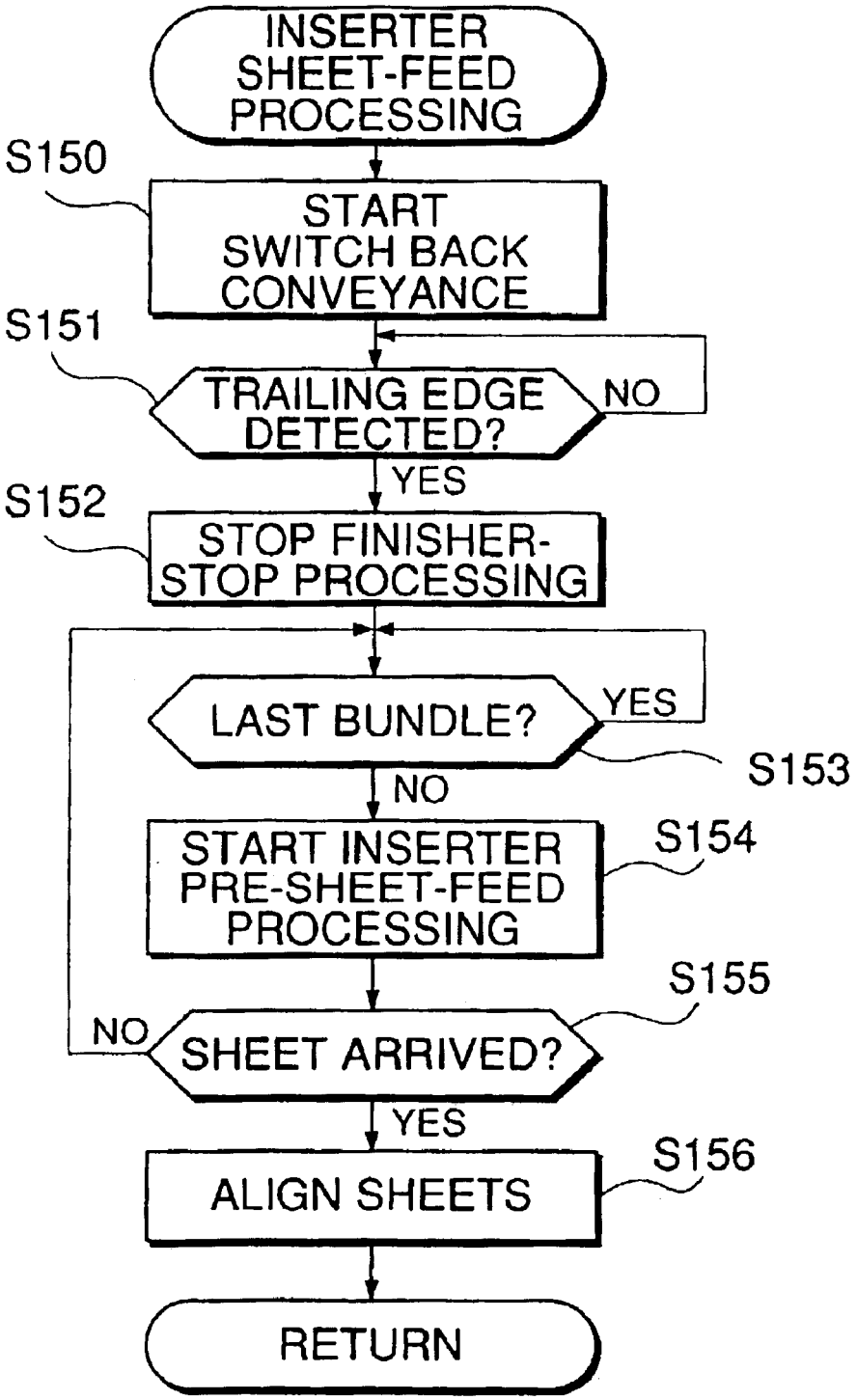
FIG. 29 is a flow chart showing an inserter sheet-feeding process executed in a step S108 of FIG. 28.

Next, the inserter sheet-feed processing in the above-mentioned step S108 will be described with reference to FIG. 29, which is a flow chart showing the process of the inserter sheet-feed processing in the step S108 of FIG. 28.

The sheet C1 from the inserter 900 is held on standby in the path 521, as shown in FIG. 18.

The inserter sheet-feed processing is initiated in this state. In this processing, the inverted conveyance (switch-back conveyance) is started in step S150. In the inverted conveyance, the directions of rotation of the entrance motor M1 and the buffer motor M2 are set opposite to the directions of rotation before the sheet is halted, and driving of each motor is started. Simultaneously with the start of the motors M1 and M2, driving of the conveyance motor M10 is started, whereby, as shown in FIG. 19, the sheet C is guided to the second book-binding path 554 via the conveyance roller pair 503.

Then, the process proceeds to step S151, to wait for the trailing edge of the sheet C to be detected by the entrance sensor 531. When the trailing edge of the sheet C is detected, finisher-stop processing is performed in step 5152. In this processing, the driving of the entrance motor M1 and the buffer motor M2 is stopped.

In the following step S153, it is determined whether the bundle of sheets being processed is the last bundle or not. If it is the last bundle, the process proceeds to step S154, where a start command is issued to start inserter pre-sheet-feed processing, and then the process proceeds to step S155. On the other hand, if the bundle of sheets is not the last bundle, the process skips over step S154, to step S155.

In step S155, the process waits for the trailing edge of the sheet to be detected by the book-binding entrance sensor 817. When the trailing edge of the sheet is detected, the process proceeds to step S156, where the above-mentioned width adjusting member is operated to align the sheets in the direction of the width of the sheets, followed by terminating the present process.

As described above according to the present embodiment, when the book-binding mode operation is performed in which a special sheet from the inserter 900 is inserted into sheets with images formed thereon, and the sheets with the special sheet inserted therein are folded in two and bound into a book which can be opened for viewing in page order, synthesizing and rearranging is performed on the images formed on the sheets such that the sheets to be bound into a book are arranged in the correct page order. On the other hand, on the side of the finisher 500, feeding of the special sheet (sheet C) from the inserter 900 is started in advance, the special sheet (sheet C) is temporarily kept on standby on the path 521, and then the sheets (sheets P) from the image forming apparatus main body are fed via the path 553 to the receiving guide 820 and received therein. After the sheets P for one job are received, the special sheet (sheet C) held on standby on the path 521 is fed by switch-back conveyance to the receiving guide 820 and received therein. The special sheet and the sheets for one job output from the printer 300 are subjected to predetermined processing (binding and folding) to bind and fold them into a single book at the receiving guide 820. This operation neither requires a complicated operation by an operator, nor impairs the printing quality of the special sheet and the durability of conveyance of the sheets from the printer 300, to thereby improve the productivity or efficiency of the book-binding mode operation of binding together the sheets with images formed thereon by the printer 300 and the special sheet into a book.

When the sort mode operation (including staple sort mode operation) is performed in which sheets with images formed thereon and the special sheet from the inserter 900 are arranged in page order, a sheet-feed operation of feeding the special sheet from the inserter 900 is started before the sheets (sheets P) are discharged from the image forming apparatus main body, and the special sheets are temporarily kept on standby on the conveyance path 908. Then, the special sheet (sheet C) is conveyed to the processing tray 630 and received therein. Subsequently, the sheets (sheets P) from the printer 300 are conveyed to the processing tray 630 and received therein until the sheets P corresponding to one job are received. As a result, neither a complicated operation by an operator is required, nor the printing quality of the special sheet and the durability of conveyance of the sheets from the printer 300 are impaired, so that the productivity or efficiency of the sort mode operation of arranging together sheets with images formed thereon by the printer 300 and the special sheet in page order can be improved. Further, when two or more copies of a mixed bundle of the sheet from the inserter 900 and the sheets from the printer 300 are prepared, the special sheet for the next job is kept on standby on the conveyance path 908 in advance while the sheets for the current job being processed are conveyed, and upon completion of predetermined operations (aligning, stapling, and bundle discharging) of the current job on the processing tray 630, the special sheet for the next job is fed to the processing tray 630 and received therein. As a result, the above mentioned effects can be further enhanced.

It is to be understood that the present invention may also be realized by supplying a system or an apparatus with a storage medium in which the program code of software that realizes the functions of the above described operations (for example, the operations as shown in FIGS. 23 to 29, etc.) of the present embodiment is recorded, and causing a computer (or CPU, MPU) of the system or apparatus to read out and execute the program code stored in the storage medium.

In this case, the program code itself read out from the storage medium realizes the above described functions of the present embodiment, so that the storage medium storing the program code also constitutes the present invention.

The storage medium for supplying the program code may be selected from, for example, a floppy disk, hard disk, optical disk, magneto-optical disk, CD-ROM, CD-R, magnetic tape, non-volatile memory card, and ROM.

The functions of the above described embodiment may be accomplished not only by executing a program code read by a computer, but also by causing an operating system (OS) that operates on the computer, to perform a part or the whole of the actual operations according to instructions of the program code.

Furthermore, the program code read out from the storage medium may be written into a memory provided in an expanded board inserted in the computer, or an expanded unit connected to the computer, and a CPU, or the like, provided in the expanded board or expanded unit may actually perform a part or all of the operations according to the instructions of the program code, so as to accomplish the functions of the above described embodiment.

What is claimed is:

1. A sheet processing apparatus for receiving a recording sheet from an image forming apparatus which forms an image on the recording sheet, the sheet processing apparatus comprising:

a cover sheet feeder for feeding a cover sheet set on a cover sheet tray toward said image forming apparatus, the cover sheet being set on the cover sheet tray in a state where a front face of the cover sheet faces upward;

a folder for folding a bundle of the cover sheet and the recording sheet and for discharging the folded bundle onto a discharge tray, said folder including a thrusting member for thrusting the bundle of the cover sheet and the recording sheet, and including a folding roller pair for folding the bundle thrust by said thrusting member; and a conveyer for conveying the cover sheet fed by said cover sheet feeder, for reversing the fed cover sheet so that the cover sheet faces downward, for conveying the reversed cover sheet to said folder in a switchback manner so that the front face of the cover sheet faces said folding roller pair.

2. A sheet processing apparatus according to claim 1, further comprising a book-binder for binding the recording sheet transported from said image forming apparatus and the cover sheet transported from said cover sheet feeder so as to make a book of the recording sheet and the cover sheet.

3. A sheet processing apparatus according to claim 2, further comprising a sheet positioning member for guiding the bundle of the recording sheet and the cover sheet from said book-binder to said folder.

4. An image forming apparatus comprising:

an image forming unit for forming an image on the recording sheet;

a cover sheet feeder for feeding a cover sheet set on a cover sheet tray toward said image forming unit, the cover sheet being set on the cover sheet tray in a state where a front face of the cover sheet faces upward;

a folder for folding a bundle of the cover sheet and the recording sheet and for discharging the folded bundle onto a discharge tray, said folder including a thrusting member for thrusting the bundle of the cover sheet and the recording sheet, and including a folding roller pair for folding the bundle thrust by said thrusting member; and a conveyer for conveying the cover sheet fed by said cover sheet feeder, for reversing the fed cover sheet so that the cover sheet faces downward, for conveying the reversed cover sheet to said folder in a switchback manner so that the front face of the cover sheet faces said folding roller pair.

5. An image forming apparatus according to claim 4, further comprising a book-binder for binding the recording sheet transported from said image forming unit and the cover sheet transported from said cover sheet feeder so as to make a book of the recording sheet and the cover sheet.

6. An image forming apparatus according to claim 5, further comprising a sheet positioning member for guiding the bundle of the recording sheet and the cover sheet from said book-binder to said folder.

7. A sheet processing apparatus for receiving a recording sheet from an image forming apparatus which forms an image on the sheet, the sheet processing apparatus comprising:

a cover sheet feeder for feeding a cover sheet set on a cover sheet tray toward said image forming apparatus, the cover sheet being set on the cover sheet tray in a state where a front face of the cover sheet faces upward;

a folder for folding a bundle of the cover sheet and the recording sheet, and for discharging the folded bundle onto a discharge tray, said folder including a thrusting member for thrusting the bundle of the cover sheet and the recording sheet, and including a folding roller pair for folding the bundle thrust by said thrusting member; and a conveyer for conveying the cover sheet fed by said cover sheet feeder, and for conveying the fed cover sheet to said folder so that the front face of the cover sheet faces said fold roller pair.

8. A sheet processing apparatus according to claim 7, further comprising a book-binder for binding the recording sheet transported from said image forming apparatus and the cover sheet transported from said cover sheer feeder so as to make a book of the recording sheet and the cover sheet.

9. A sheet processing apparatus according to claim 8, further comprising a sheet positioning member for guiding the bundle of the recording sheet and the cover sheet from said book-binder to said folder.

10. An image forming apparatus comprising:

an image forming unit for forming an image on a recording sheet;

a cover sheet feeder for feeding a cover sheet set on a cover sheet tray toward said image forming unit, the cover sheet being set on the cover sheet tray in a state where a front face of the cover sheet faces upward;

a folder for folding a bundle of the cover sheet and the recording sheet and for discharging the folded bundle onto a discharge tray, said folder including a thrusting member for thrusting the bundle of the cover sheet and the recording sheet, and including a folding roller pair for folding the bundle thrust by said thrusting member; and a conveyer for conveying the cover sheet fed by said cover sheet feeder, and for conveying the fed cover sheet to said folder so that the front face of the cover sheet faces said fold roller pair.

11. An image forming apparatus according to claim 10, further comprising a book-binder for binding the recording sheet transported from said image forming unit and the cover sheet transported from said cover sheer feeder so as to make a book of the recording sheet and the cover sheet.

12. A image forming apparatus according to claim 11, further comprising a sheet positioning member for guiding the bundle of the recording sheet and the cover sheet from said book-binder to said folder.

* * * * *